US009624077B1

(12) United States Patent
Jordan et al.

(10) Patent No.: US 9,624,077 B1
(45) Date of Patent: Apr. 18, 2017

(54) JACK APPARATUS FOR LIFTING AND SUPPORTING AN ITEM FOR HOLDING WINDABLE MATERIAL

(71) Applicants: David S. Jordan, Knoxville, TN (US); Michael C. Jordan, Knoxville, TN (US)

(72) Inventors: David S. Jordan, Knoxville, TN (US); Michael C. Jordan, Knoxville, TN (US)

(73) Assignee: iTool Equipment Holding LLC, Oak Ridge, TN (US)

( * ) Notice: Subject to any disclaimer, the term of this patent is extended or adjusted under 35 U.S.C. 154(b) by 129 days.

(21) Appl. No.: 14/544,145

(22) Filed: Dec. 2, 2014

(51) Int. Cl.
*B66F 3/46* (2006.01)

(52) U.S. Cl.
CPC ..... *B66F 3/46* (2013.01)

(58) Field of Classification Search
CPC ..... B66F 3/46; B66F 3/10; B66F 9/07504
USPC ..... 254/89 R, 94, 92, 89 H
See application file for complete search history.

(56) References Cited

U.S. PATENT DOCUMENTS 3,850,409 A * 11/1974 Davis ..... B66F 13/00 254/133 R
7,717,665 B2 * 5/2010 Jenkins ..... B65G 57/302 187/360
8,025,261 B2 * 9/2011 Jordan ..... B65H 49/321 248/168
2009/0139803 A1 * 6/2009 Smeeton ..... B66F 9/07504 187/408
2011/0253954 A1 * 10/2011 Fortner ..... B66F 3/10 254/98
2015/0008383 A1 * 1/2015 Bainter ..... B66F 1/08 254/93 R
2015/0166313 A1 * 6/2015 Knapp ..... B66F 7/025 254/89 R

* cited by examiner

*Primary Examiner* — Joseph J Hail
*Assistant Examiner* — Henry Hong
(74) *Attorney, Agent, or Firm* — Michael E. McKee

(57) ABSTRACT

Apparatus for lifting and supporting an item above a floor includes a frame and a pair of upright telescoping post assemblies having two opposite ends and which are positionable on opposite sides of the item to be lifted. A pair of guide posts are arranged as to extend substantially vertically of the frame and adjacent the post assemblies. A carriage assembly is mounted upon each post assembly for cooperating between the item and an adjacent guide post, and jacks are utilized for moving the ends of the post assemblies apart so that by positioning the carriage assemblies in cooperating relationship with the item and moving the ends of the post assemblies apart, the item is lifted by a corresponding amount and the carriage assemblies are guided along the guide posts.

19 Claims, 9 Drawing Sheets

JACK APPARATUS FOR LIFTING AND SUPPORTING AN ITEM FOR HOLDING WINDABLE MATERIAL

BACKGROUND OF THE INVENTION

This invention relates generally to material handling apparatus and relates, more particularly, to apparatus used to lift and support an item, such as a spool about which material is wound or can be wound, as the item is rotated for the purpose of either winding the material from the item or winding the material about the item or for transporting the item to an alternative site.

At a construction job site, an item, such as a relatively large spool of coiled material, such as wire or cable, is commonly desired to be supported above a floor to facilitate the unwinding of material from the spool or the winding of material about the spool. For these purposes, there exists a class of apparatus including a pair of stands which are positionable on opposite sides of the spool and are capable of lifting the opposite sides of the spool from the floor to a desired elevated position at which the item can be rotated during either a material unwinding process or a material winding process. Moreover, such stands have been equipped with casters enabling the elevated spool to be wheeled across the floor to an alternative site. An example of a pair of wheeled stands capable of lifting the item from the floor to an elevated position for material winding or unwinding purposes and which enables the item, while elevated, to be manually wheeled across the floor is shown and described in our co-pending U.S. patent application Ser. No. 13/986,407, the disclosure of which is incorporated herein by reference.

However, some items of windable material, such a large spool of wire wound thereabout, are simply too large or heavy to be easily lifted by conventional stands. Furthermore and even if lifted to an elevated condition, they are likely to be too heavy to be manually rolled across the floor or not durable enough to be moved with a forklift, or forklift truck.

It would be desirable to provide an apparatus of the aforedescribed class which embodies stands, or jacks, which are capable of lifting and supporting relatively heavy items of windable material whose size can fall within a broad range of sizes and whose construction is durable enough to enable the apparatus, with the relatively heavy item supported thereby, to be moved to an alternative site by way of a forklift.

Accordingly, it is an object of the present invention to provide a new and improved apparatus of the aforedescribed class for lifting and supporting an item, such as a heavy spool for holding windable material, to facilitate the rotation of the item for the purpose of unwinding material from the item or winding material about the item or for transport of the lifted item to an alternative site as the apparatus is either rolled across the floor or is moved with a forklift.

Another object of the present invention is to provide such an apparatus having a jack whose components can be quickly adjusted through relatively large distances for placement of the jack into position for lifting the item.

Still another object of the present invention is to provide such an apparatus having a jack whose components are reinforced in a manner which appreciably increases the durability of the apparatus.

Yet another object of the present invention is to provide such an apparatus having wheels which enables the apparatus to be wheeled across the floor or which can be removed to enable the apparatus frame to rest directly upon a floor.

A further object of the present invention is to provide such an apparatus which is capable of lifting a spool of windable material whose diameter falls within a relatively broad range of spool diameters or whose width falls within a relatively broad range of spool widths.

A still further object of the present invention is to provide such an apparatus which utilizes a motor for rotating a spool being supported by the apparatus.

A yet still another object of the present invention is to provide such an apparatus which is uncomplicated in structure, yet effective in operation.

SUMMARY OF THE INVENTION

This invention resides in an apparatus for lifting and supporting an item in an elevated condition above an underlying floor wherein the item includes a centrally-disposed barrel having two opposite ends and about which a windable material can be either wound or unwound and two flanges wherein each flange is disposed at each end of the barrel and has a rim along the periphery thereof and the item is arranged so that the rims of both flanges engage the underlying floor and the barrel of the item is oriented substantially parallel to the floor.

The apparatus includes a frame including a pair of sections which are joined in a stationary relationship with respect to one another and are positionable on opposite sides of the item to be lifted so that one section of the frame is disposed adjacent one flange of the item and the other section of the frame is disposed adjacent the other flange of the item. The frame further includes a pair of guide posts having two opposite ends wherein one guide post is mounted upon one of the sections of the frame so as to extend substantially upwardly therefrom and the other guide post is mounted upon the other of the sections of the frame so as to extend substantially upwardly therefrom. In addition, there is provided a pair of elongated post assemblies having upper and lower ends wherein one of the post assemblies is mounted upon one section of the frame adjacent the guide post mounted thereon so that the upper end thereof extends substantially upwardly from said one section and the other of the post assemblies is mounted upon the other section of the frame and adjacent the guide post mounted thereon so that the upper end thereof extends substantially upwardly from said other section, and wherein the upper and lower ends of each post assembly are movable with respect to one another to alter the distance therebetween.

The apparatus also includes a pair of jacks wherein one of the two jacks is associated with one post assembly for moving the upper and lower ends of the one post assembly relative to one another to alter the distance therebetween and the other of the two jacks is associated with the other post assembly for moving the upper and lower ends of the other post assembly relative to one another to alter the distance therebetween. Furthermore, there is provided a pair of carriage assemblies wherein one carriage assembly is mounted upon one post assembly and the other carriage assembly is mounted upon the other post assembly so that movement of the upper and lower ends of the post assemblies relative to one another effects the movement of the carriage assemblies upwardly or downwardly relative to the apparatus frame. In addition, each carriage assembly is cooperable with a corresponding end of the barrel of the item and with the guide post disposed adjacent the post assembly upon which the carriage assembly is mounted so that by positioning each carriage assembly in cooperating relationship with a corresponding end of the barrel of the item for the purpose of lifting the corresponding end of the barrel with the carriage assembly and moving the upper and lower ends of the post assembly away from one another, the flange of the item with which is disposed at the corresponding end of the barrel is lifted from the floor by a corresponding amount and the carriage assembly is guided along the length of the guide post.

DETAILED DESCRIPTION OF AN ILLUSTRATIVE EMBODIMENT

Figure 1:
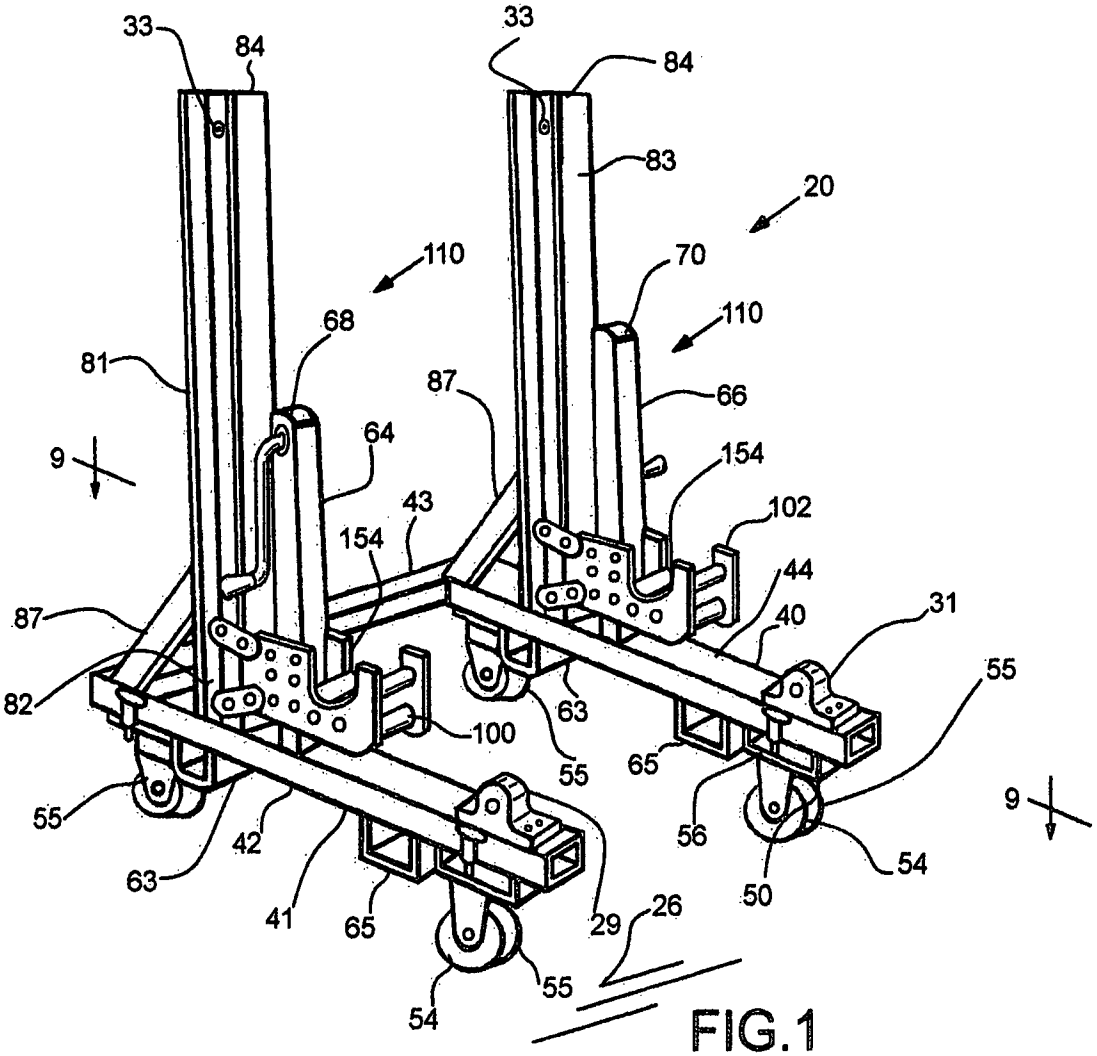
FIG. 1 is a perspective view of an embodiment of a jack apparatus within which features of the present invention are embodied.
Figure 2:
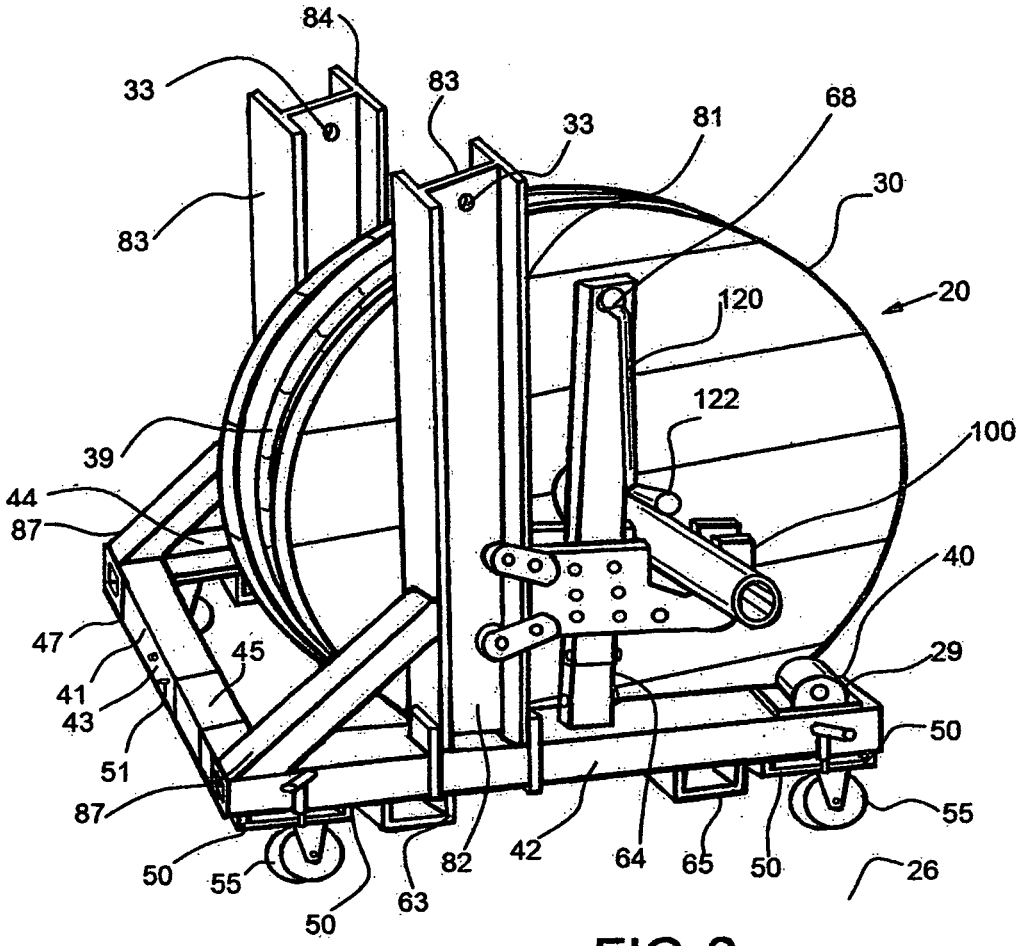
FIG. 2 is a perspective view of a fragment of the FIG. 1 embodiment, as seen from an alternative angle, shown being utilized to support a spool of windable material in an elevated condition above a floor.

Turning now to the drawings in greater detail and considering first FIG. 1, there is illustrated an embodiment, generally indicated 20, of a jack apparatus within which features of the present invention are embodied; and in FIG. 2, the apparatus 20 is shown being used for supporting a spool 30 of coiled material 39 in an elevated condition above an underlying floor 26 so that the spool 30 can be rotated about a substantially horizontal axis for the purposes of unwinding the material 39 from the spool 30 or for winding the material 39 about the spool 30 or for transport of the spool 30 to an alternative site. As the spool 30 is supported in an elevated condition by the apparatus 20, the apparatus 20, in turn, can be wheeled across the floor 26 upon its wheel assemblies 55 or can be bodily lifted by a forklift 21 (FIG. 12) and transported by the forklift 21 to an alternative site.

Figure 3:
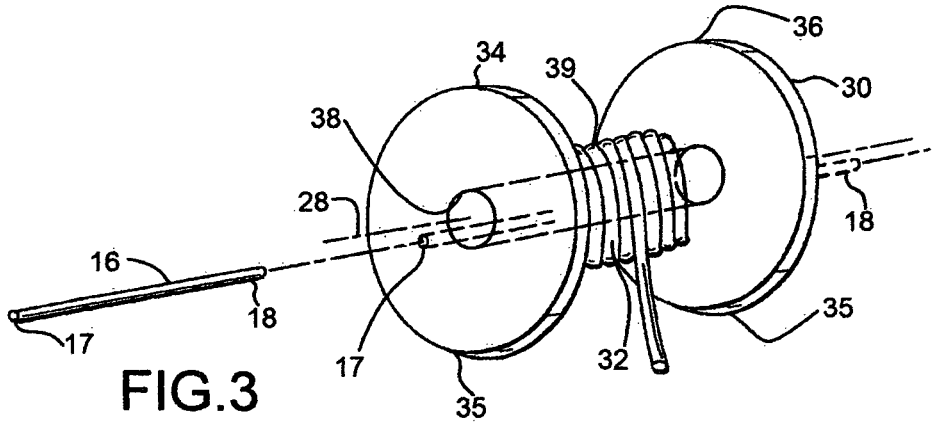
FIG. 3 is a perspective view of the FIG. 2 spool shown resting upon the underlying floor and an elongated tube which is positionable through the spool for purposes of lifting the spool from the floor with the FIG. 1 apparatus.

With reference still to FIGS. 2 and 3, the spool 30 is of a class of spools which can be lifted and supported by the apparatus 20. Briefly, the spool 30 includes a centrally-disposed, hollow elongated barrel 32 about which a length of coiled material 39, such as electrical wire, steel cable, or rope or flexible sheet material, such as flexible flooring material, is wound and includes a pair of disc-like flanges 34, 36 attached to the opposite ends of the barrel 32 on the opposite sides of the spool 30. Each flange 34 or 36 is circular in form and defines a cylindrical rim 35 along its peripheral edge. Furthermore, there is commonly provided a bore 38 which extends through the center of both flanges 34, 36 and the elongated barrel 32. In addition, the bore 38 defines an elongated axis 28 about which the spool 30 is rotated as the spool 30 is supported by the apparatus 20 in an elevated condition above the floor 26 to facilitate the unwinding of the material 39 about the spool 30 or winding of the material 39 about the spool 30.

Furthermore, there is illustrated in FIG. 3 an elongated tube 16 having two opposite end portions 17 and 18 and which can be inserted endwise through the bore 38 of the spool 30 from, for example, the position depicted in solid lines in FIG. 3 to the position depicted in phantom in FIG. 3 so that the end portions 17 and 18 extend out of the bore 38 on opposite sides of the spool 30 and thus outboard of the flanges 34, 36. As will be apparent herein, it is these outwardly-extending end portions 17 and 18 of the tube 16 that are engaged and directly acted upon by the jack apparatus 20 during a spool-lifting operation.

With reference again to FIGS. 1 and 2 and as will be described herein, the jack apparatus 20 includes a frame 40 including elongated sections 42, 44 and guide posts 81, 83, and the apparatus 20 further includes a pair of carriage assemblies 100, 102 which are supported upon the frame 40 by way of a pair of jack-extendible telescoping post assemblies 64, 66. While the spool 30 rests upon the floor 26 (as best shown in FIG. 3) so that the barrel 32 thereof is arranged substantially horizontally and the rims 35 of its flanges 34, 36 engage the floor 26, the apparatus 20 can be wheeled into a position about the spool 30 so that the carriage assemblies 100, 102 are disposed directly beneath the end portions 17, 18 of the tube 16. At that point, the carriage assemblies 100, 102 are raised relative to the frame 40 by way of the telescoping post assemblies 64, 66 and moved into cooperating relationship with the spool 30 (at which the carriage assemblies 100, 102 are in position for acting upon the spool 30 by way of the tube 16 interposed therebetween for the purpose of lifting the spool 30) as the upward movement of the carriage assemblies 100, 102 is guided along the guide posts 81, 83 of the frame 40. As the carriage assemblies 100, 102 continue to be raised, the spool 30 is lifted from the floor 26 to an elevated condition. As will be apparent herein, the guide posts 81, 83 reinforce and rigidify the telescoping post assemblies 64, 66 and thereby strengthen the apparatus 20 during use or during the movement of the apparatus 20 to an alternative site.

Figure 4:
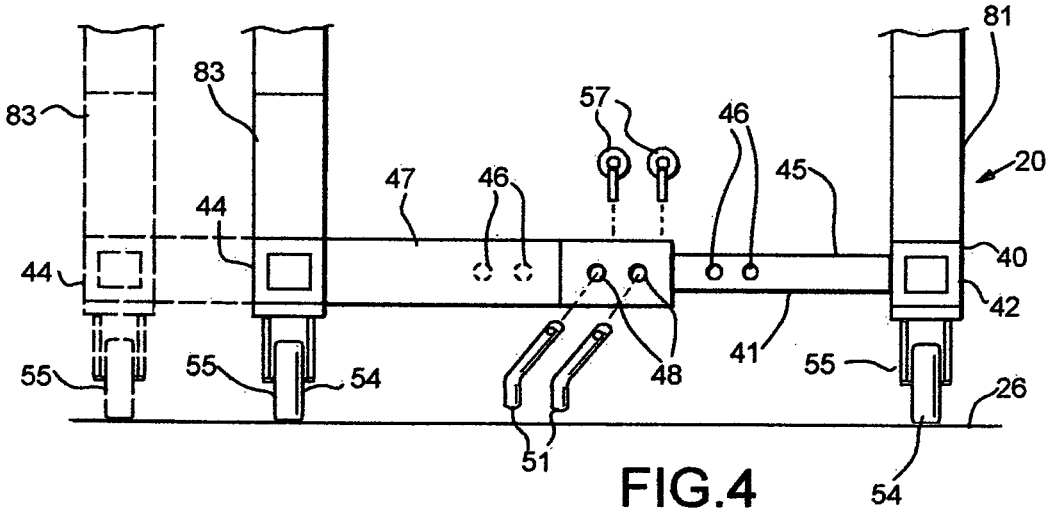
FIG. 4 is a back elevation view of a fragment of the frame of the FIG. 1 embodiment as seen generally from the left in FIG. 1.
Figure 12:
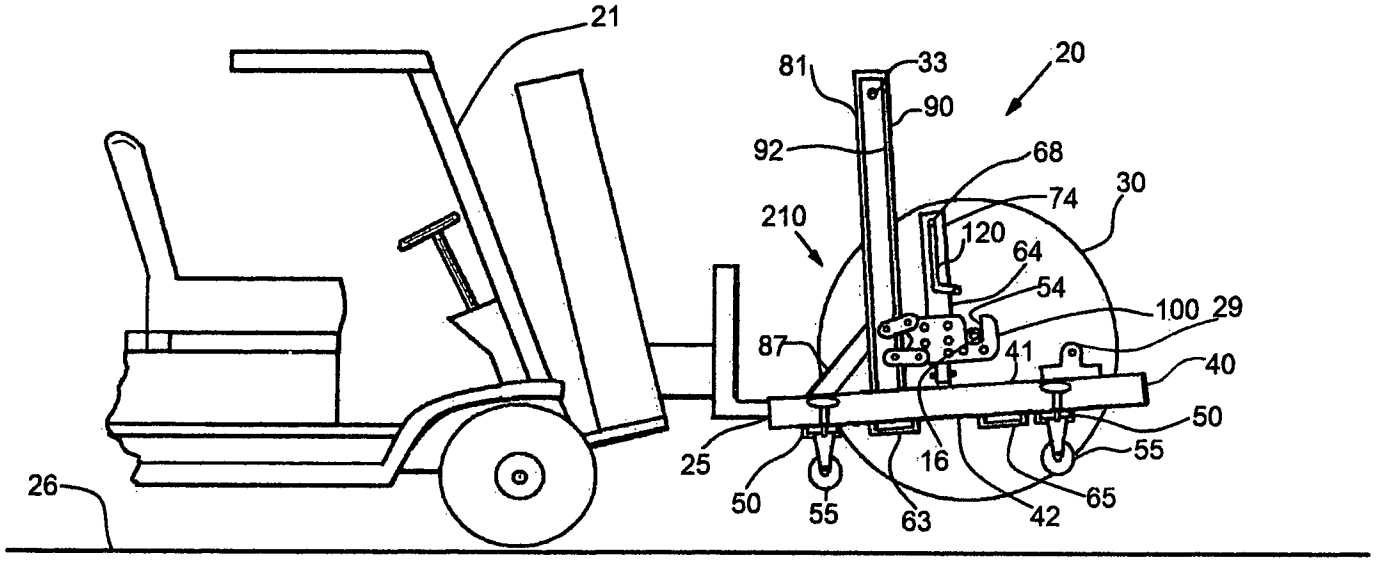
FIG. 12 is a side elevation view of the FIG. 1 embodiment, with a spool supported thereby, shown lifted to an elevated condition above the underlying floor by a forklift.

With reference to FIGS. 1, 2 and 4, the frame 40 (introduced earlier) of the assembly 20 includes a base 41 of substantially U-shaped configuration. More specifically, the base 41 includes the pair of lengthy elongated sections 42 and 44 (introduced earlier) which are arranged in a substantially parallel relationship with one another and which are joined at one end to an intermediate assembly 43 so the elongated sections 42, 44 provide the legs of the U-shaped base 41 and the intermediate member 43 provides the bottom of the U-shaped configuration of the base 41. Each section 42 or 44 or assembly 43 of the depicted base 41 is constructed of steel channel having a substantially rectangular cross section, and one end of each of the sections 42 and 44 is joined to a corresponding end of the intermediate assembly 43 with welds. Furthermore, each end of each section 42 or 44 is open and sized to accept a fork 25 (of two forks) of a forklift 21 (FIG. 12) for lifting the frame 40 with the forklift 21. Along the same lines and and since the sections 42, 44 are open at each end (i.e. the front and rear) of the frame 40, the apparatus 20 can be lifted with the forks 25 of a forklift 21 from the front of the apparatus 20 or from the rear of the apparatus 20, as shown in FIG. 12.

It is a feature of the apparatus 20 that its base 41 can be adjusted in width to accommodate a spool 30 having a width within a relatively large range of spool widths. To this end, the intermediate assembly 43 includes a pair of channel members 45, 47 wherein one member 45 is slidably accepted by the other member 47 to accommodate a lengthening or shortening of the assembly 43 in a telescoping fashion. In addition, the member 45 defines a series of spaced through-openings 46 along the length thereof, and the member 47 defines a pair of through-openings 48 along the length thereof which can be selectively aligned with a pair of the through-openings 46 provided in the member 45. A pair of pins 51 are provided whose shanks can be positioned within the aligned through-openings 46, 48 and secured therein with a key 57 to maintain the members 45, 47 in a stationary relationship with respect to one another (and thereby secure the elongated sections 42, 44 in a stationary relationship with respect to one another).

Therefore and in order to adjust the spaced distance between the elongated sections 42 and 44 to thereby accommodate the capacity of the elongated sections 42, 44 to be positioned outboard of the flanges 34. 36 of the spool 30 when the apparatus 20 is positioned thereabout, the pins 51 can be removed from the aligned through-openings 46, 48, and the members 45 and 47 can then be slidably moved longitudinally relative to one another to lengthen or shorten the intermediate assembly 43, as necessary, by shifting the elongated section 44 relative to the position shown in solid lines in FIG. 4 and the position shown in phantom in FIG. 4 and so that an alternative pair of through-openings 46 of the member 45 are aligned with the pair of openings 48 of the member 47. The pins 57 can thereafter re-inserted into the aligned through-openings 46, 48 (and secured therein with the keys 57) to re-secure the members 45, 47 in a stationary condition with respect to one another.

Figure 5:
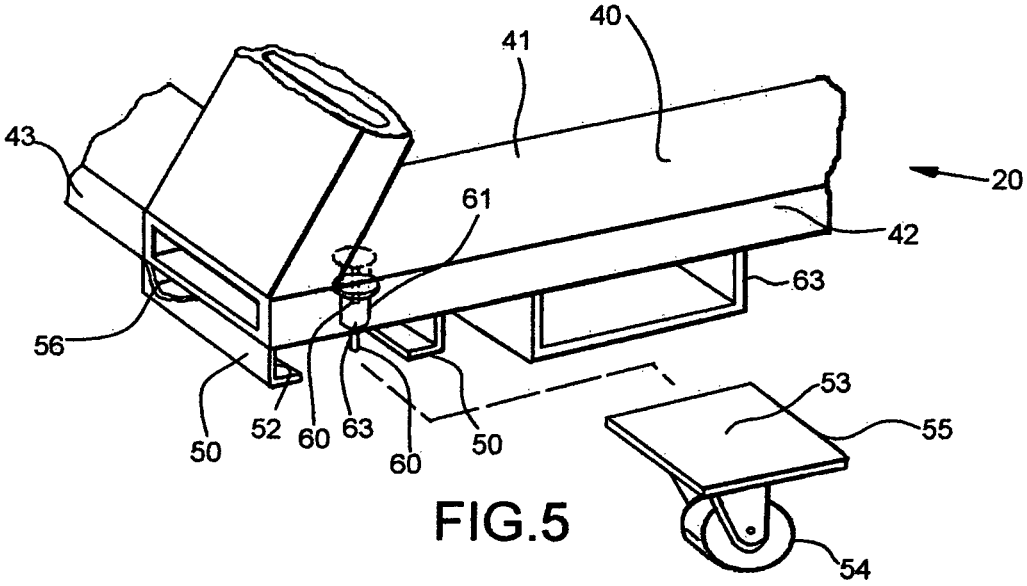
FIG. 5 is a perspective view of a fragment of the frame of the FIG. 1 apparatus depicting one of the apparatus wheels removed therefrom and being partially cut-away.

It is also a feature of the apparatus 20 that the base 41 of the apparatus frame 40 can either be wheeled across the floor 26 or, in the alternative, rest directly upon the floor 26. In this connection, there are provided removable wheel assemblies 55 which can be selectively mounted upon the underside of the base 41 to enable the frame 40 to be rolled across the floor 26 or removed from the base 41. To this end and as exemplified by the fragment of the apparatus 20 illustrated in FIG. 5, there is provided a pair of L-shaped brackets 50 which are welded to the underside of the base 41 at each end of the sections 42 and 44 so that the legs of the brackets 50 provide opposite sides of a guide track 52 therealong. Each wheel assembly 55 includes a steel plate 53 and a wheel 54 rollably mounted beneath the plate 53, and the plate 53 can be slidably accepted by the guide track 52 to mount the wheel assembly 55 beneath the base 41. The plate 53 is secured in place along the guide track 52 by way of a stop member 56 (FIG. 5) welded to each bracket 50 adjacent the rear of the guide track 52 and a spring-biased pin 60 which is mounted to the section 42 or 44 adjacent the mouth of the guide track 52.

The spring-biased pin 60 is mounted within a housing 61 which, in turn, is secured to one side surface of the section 42 or 44 so that the shank, indicated 63, of the pin 60 is spring-biased toward an extended position across the mouth of the guide track 52. Therefore and by lifting the pin 60 (against the force of a biasing spring mounted within the housing 61) from the (extended) solid-line position illustrated in FIG. 5 to the (retracted) position illustrated in phantom in FIG. 5, the mouth of the corresponding guide track 52 is opened and is therefore in a condition to slidably accept the plate 53 inserted edgewise therein or to remove the plate 53 from the guide track 52. Conversely and by permitting the pin 60 to return (under the force of the biasing spring) from the FIG. 5 (retracted) phantom-line position to the FIG. 5 (extended) solid-line position, the mouth of the guide track 52 is closed so that the plate 53, when positioned within the guide track 52, is captured along the guide track 52 between the stop members 56 and the pin 60. It follows that the wheel assemblies 55 can be mounted to the frame 40 by way of the guide tracks 52 to permit the frame 40 to be rolled, or wheeled, across the floor 26 as the wheels 54 of the assemblies 55 are rollably moved across the floor 26 or bodily removed from the guide tracks 52 (by removal of the plates 53 therefrom) to enable the base 41 of the frame 40 to rest directly upon the floor 26.

The wheels 54 of the wheel assemblies 55 can be unidirectional (i.e. not adjustable in direction) or can be adjustable in direction (e.g. casters). Moreover, such wheel assemblies 55 can incorporate foot-operable brakes (known in the art) for selectively permitting or inhibiting the rotation of the wheels 54 about the rotation axes thereof.

With reference again to FIGS. 1 and 2, the frame 40 of the depicted apparatus 20 is provided with a pair of open-ended U-shaped forklift brackets 63, 65 on each side of the frame 40 which are each adapted to accept the forks 25 (FIG. 12) of a forklift 21 used to bodily lift the apparatus 20 and any spool 30 supported thereby from the floor 26. Within the apparatus 20 and as shown in FIG. 1, two brackets 63, 65 are fixedly attached (i.e. welded) to the underside of each section 42 or 44 so as to provide, with the underside of the section 42 or 44, a fork-accepting slot which opens away from one side of the frame 40; and the brackets 63, 65 are spaced along the length of the elongated sections 42, 44 so that the weight of the apparatus 20 and any spool 30 supported thereby is substantially centered between the brackets 63, 65—and thus between the forks 25 of the forklift 21 accepted by the brackets 63, 65, for the purpose of lifting the apparatus 20 with the forks 25. Therefore and to lift the apparatus 20 with the forklift 21, the forks 25 thereof are directed tip end-first in sequence through the brackets 63, 65 secured beneath one section 42 or 44 of the frame 40 and then through the brackets 63, 65 secured beneath the other section 44 or 42 of the frame 40 so that portions of the forks 25 are positioned beneath both sections 42 and 44 for supporting the weight of the apparatus 20 transmitted to the sections 42, 44. It follows that the openings in the forklift brackets 43, 45 provide fork-accepting slots which enable the frame 40 to be raised by a forklift 21 from either side of the frame 40 while the open ends of the sections 42, 44 provide fork-accepting slots which enable the frame 40 to be raised by a forklift 21 from either the front or the rear of the apparatus frame 40.

Figure 9:
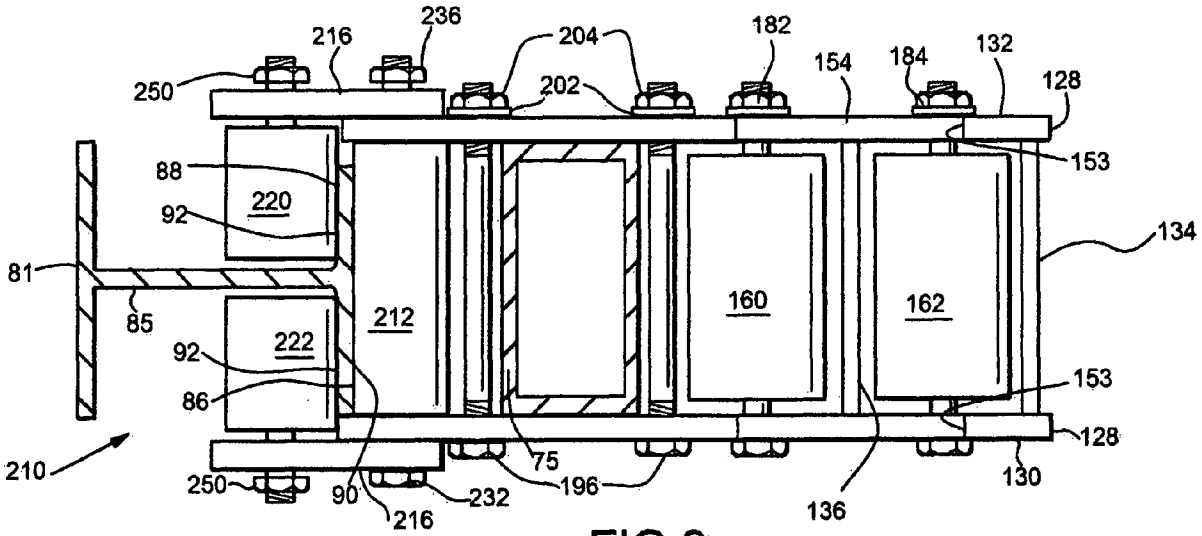
FIG. 9 is a top plan view of one of the carriage assemblies of the FIG. 1 apparatus taken about along line 9-9 of FIG. 1.
Figure 10:
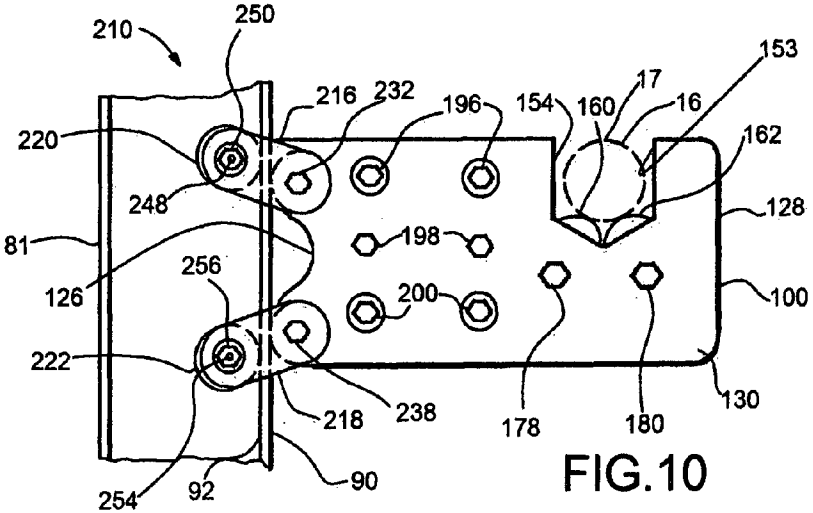
FIG. 10 is a side elevation view of the carriage assembly of FIG. 9, as seen from below in FIG. 9.

With reference again to FIGS. 1 and 2, the frame 40 also includes a pair of guide posts 81, 83 which are joined to so as to extend upwardly from the sections 42 and 44. In this connection, each guide post 81 or 83 includes opposite lower and upper ends 82, 84, respectively, and the lower end 82 is mounted upon and secured to (e.g. welded to) the upper surface of a corresponding section 42 or 44 so that the upper end 84 of the guide post 81 or 83 is directed upwardly from the corresponding section 42 or 44. As best shown in FIGS. 9 and 10, each guide post 81 or 83 is constructed of steel channel having an I-shaped cross section including a primary (central) portion 85 and portions 86, 88 which extend outwardly of the primary portion 85 at one end thereof. Moreover, these outwardly-extending portions 86, 88 define opposite surfaces 90 and 92 which are planar in form and, as will be apparent herein, provide linear guide tracks which extend between the lower and upper ends 82, 84 of the post 81, 83 and along which a corresponding carriage assembly 100 or 102 is guided as the carriage assembly 100 or 102 is raised or lowered with respect to the frame 40. Further still and with reference again to FIGS. 1 and 2, an angularly-disposed brace member 87 is secured (i.e. welded) between each section 42 or 44 (at a location adjacent rear of the frame 40) and the corresponding post 81 or 83 mounted upon the section 42 or 44 to help maintain the posts 81 and 83 in a stable and stationary relationship with respect to the elongated sections 42, 44 upon which the posts 81, 83 are mounted.

With reference again to FIG. 1, the depicted frame 40 also includes a pair of pillow blocks 29, 31 which are mounted (e.g. with bolts) upon the upper surfaces of the elongated sections 42, 44 adjacent one (i.e. the front) end of the frame 40, and each guide post 81 or 83 is provided with a through-opening 33 disposed adjacent the upper end thereof. These pillow blocks 29, 31 and through-openings 33 can be used to bodily lift the apparatus 20, and any spool 30 supported thereby, by an overhead crane (not shown). In other words, the pillow blocks 29, 31 and the through-openings 33 of the guide posts 81, 83 provide openings through which hooks (which are suspended from an overhead crane) can be directed for purposes of lifting the apparatus 20 and the spool 30 supported thereby by way of the crane.

With reference to FIGS. 1, 2, 6 and 7, the apparatus 20 also includes a pair of jack-extendible telescoping post assemblies 64, 66 (introduced earlier) for acting between the base 41 and the carriage assemblies 100, 102 for purposes of lifting and supporting the spool 30 above the floor 26. Within the depicted apparatus 20, each telescoping post assembly 64 or 66 includes an arrangement of outer and inner sections (described herein) which are mounted upon a corresponding section 42 or 44 so as to extend substantially upwardly therefrom and an associated jack assembly 68 or 70 for moving the opposite ends of the post assembly 64 or 66 toward or away from one another and thereby raise or lower the carriage assembly 100 or 102, and thus the item (i.e. the spool 30) being supported by the post assembly 64 or 66.

Figure 6:
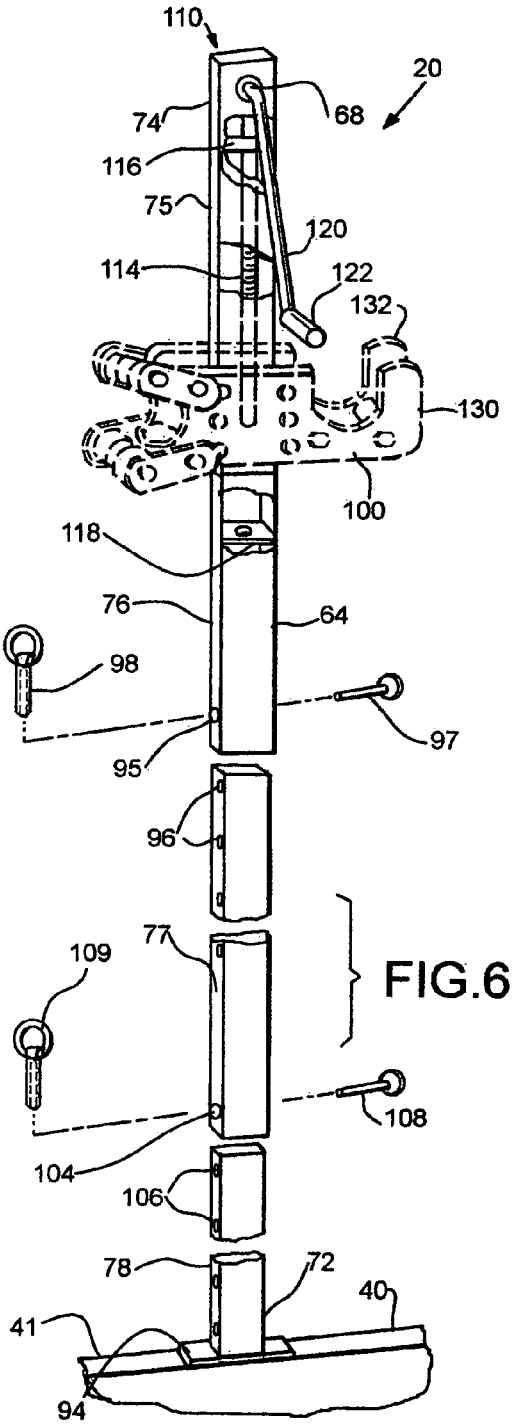
FIG. 6 is a perspective view of a telescoping post assembly of the FIG. 1 apparatus, shown exploded and partially cut-away.
Figure 7:
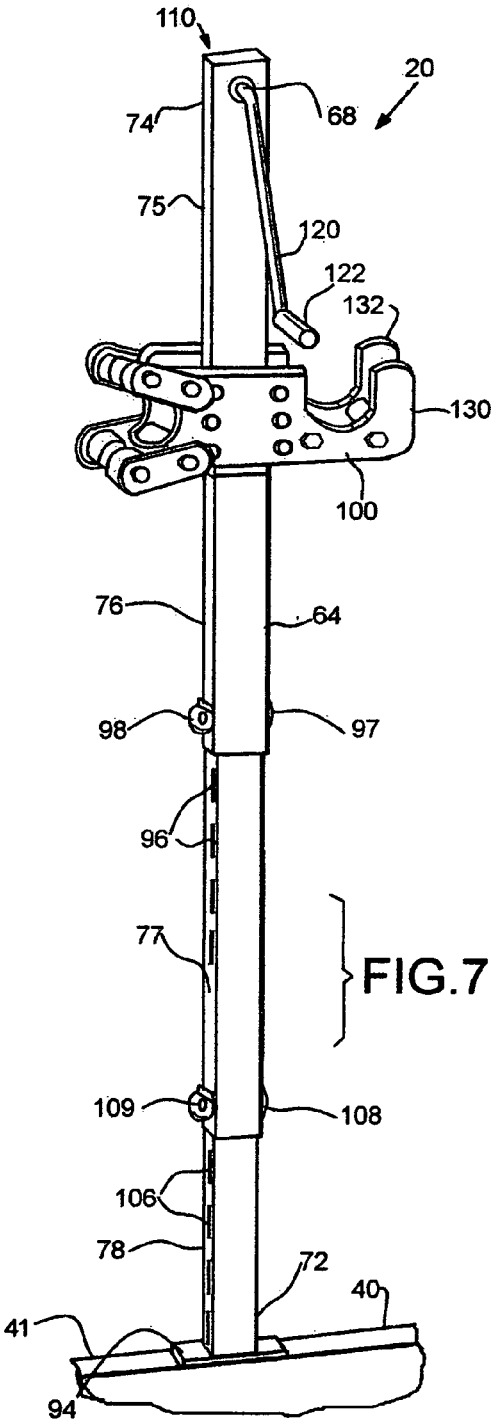
FIG. 7 is a perspective view of the telescoping post assembly of FIG. 6, shown assembly and disposed in its fully-extended condition.

As exemplified by the post assembly 64 of FIGS. 6 and 7, each post assembly 64 or 66 includes two opposite lower and upper ends 72 and 74, respectively, and which is joined at one (i.e. the lower) end 72 to a corresponding elongated section 42 or 44 so that the other (i.e. the upper) end 74 of the post assembly 64 or 66 extends substantially upwardly therefrom. Each telescoping post assembly 64 or 66 includes a hollow outer tube section 75 (which provides the upper end 74 of the post assembly 64 or 66) and a series of inner tube sections (described herein) which are accepted by one another and the outer tube section 75 in a nested relationship to permit the post assembly 64 or 66 to be lengthened or shortened as the inner tube sections and the outer tube section 75 are moved longitudinally with respect to one another in a telescoping fashion.

In connection with the foregoing, each post assembly 64 or 66 of the depicted apparatus 20 includes a first inner tube section 76 which is nestingly accepted by the hollow interior of the outer tube section 75 for sliding movement therealong, a second inner tube section 77 which is nestingly accepted by the hollow interior of the first inner tube section 76 for sliding movement therealong, and a third inner tube section 78 which is nestingly accepted by the hollow interior of the second inner tube section 77 for sliding movement therealong. Insofar as the third inner tube section 78 provides the lowermost section of the telescoping sections of each post assembly 64 or 66, it is the third inner tube section 78 which provides the lower end 72 of the post assembly 64 or 66 of the depicted apparatus 20.

It follows from the foregoing that the outer and inner tube sections 75, 76, 77 and 78 are sized to permit the tube sections 75, 76, 77 and 78 to telescopically move relative to one another and thereby permit the spaced distance between the lower and upper ends 72, 74 of the post assembly 64 or 66 to be altered. Within the depicted apparatus 20, each of the outer and inner tube sections 75, 76, 77 and 78 is comprised of steel tubing having a substantially square cross section and is sized to permit the tube sections 75, 76, 77, 78 to be arranged in the aforedescribed nested relationship.

For attachment of each telescoping post assembly 64 and 66 to a corresponding elongated section 42 or 44, the lowermost inner tube section 78 is joined (as by welding) to a horizontally-disposed base plate 94 which, in turn, is joined (as by welding) to the upper surface of a corresponding section 42 or 44 so that the post assembly 64 or 66 extends upwardly therefrom. Furthermore, there is provided along the length of the first inner tube section 76 (and adjacent the lower end thereof) a through-opening 95, and there is provided along the length of the second inner tube section 77 a series of through-openings 96. Each of the through-opening 95 and 96 opens front-to-rear with respect to the frame 40. The first inner tube section 76 can be moved longitudinally (i.e. lengthways) of the inner second tube section 77 to selectively align the through-opening 75 with any through-opening 96 of the series of through-openings 96. The first and second inner tube sections 76 and 77 can be secured in position with respect to one another by inserting a pin 97 through the aligned openings 95 and 96, and the pin 97 is secured within the aligned through-openings 95 and 96 with a key 98. It follows that in order to adjust the positional relationship between the first and second inner tube sections 76, 77 (and thereby adjust the spaced distance between the upper end of the first inner section 76 and the lower end of the second inner tube section 77), the pin 97 is removed from the aligned openings 95 and 96, the first inner tube section 76 is slidably moved along the length of the second inner tube section 77 to align the through-opening 95 with an alternative through-opening 96, and the pin 97 is re-inserted through the aligned through-openings 95, 96 to re-secure the first and second inner tube sections 76, 77 in a fixed positional relationship with respect to one another.

Further still, there is provided along the length of the second inner tube section 77 (and adjacent the lower end thereof) a through-opening 104, and there is provided along the length of the third inner tube section 78 a series of through-openings 106. The second inner tube section 77 can be moved longitudinally (i.e. lengthways) of the third inner tube section 78 to selectively align the through-opening 104 with any through-opening 106 of the series of through-openings 106. The second and third inner tube sections 77 and 78 can be secured in position with respect to one another by inserting a pin 108 through the aligned openings 104 and 106, and the pin 108 is secured within the aligned through-openings 104, 106 with a key 109. It follows that in order to adjust the positional relationship between the second and third inner tube sections 77, 78 (and thereby adjust the spaced distance between the upper end of the second inner tube section 77 and the lower end of the third inner tube section 78, the pin 108 is removed from the aligned openings 104 and 105, the second inner tube sections 77 is slidably moved along the length of the third inner tube section 78 to align the through-opening 104 with an alternative through-opening 106, and the pin 108 is re-inserted through the aligned through-openings 104, 106 to re-secure the second and third inner tube sections 77, 78 in a fixed positional relationship with respect to one another.

It is also a feature of the apparatus 20 that it includes means, generally indicated 110 in FIGS. 1, 6 and 7, for telescopically moving the outer tube sections 75 and the first inner tube section 76 relative to one another to thereby alter the distance between the lower end of the first tube section 75 and the outer tube section 75. Within the depicted apparatus 20 and as best shown in FIG. 6, the moving means 110 includes the aforementioned screw jack assemblies 68, 70 which are associated with each of the telescoping post assemblies 64 and 66 enabling a user to mechanically move the opposite lower and upper ends 72 and 74 of a corresponding post assembly 64 or 66 toward and away from one another. As best shown in FIG. 6, each jack assembly 68 or 70 includes a substantially vertically-oriented externally-threaded screw 114 which is rotatably mounted within the interior of the outer tube section 75 by way of a bearing member 116 mounted adjacent the upper end, as viewed in FIG. 6, of the outer tube section 75 and an internally-threaded nut, or collar member 118, which is fixedly secured within the interior of the inner tube section 76 adjacent the upper end thereof. With the screw 114 threadably accepted by the collar member 118, rotation of the screw 114 in one rotational direction along the length of the outer tube section 75 forcibly moves the upper end of the outer tube section 75 and the lower end of the first inner tube section 76 away from one another, and rotation of the screw 114 in the opposite rotational direction along the length of the outer tube section 75 forcibly moves the upper end of the outer tube section 75 and the lower end of the first inner tube section 76 toward one another.

To facilitate the manual manipulation, or rotation, of the screw 114 by a user, there is provided a handle 120 which is joined (by way of a gear mechanism) to one end of the screw 114 adjacent the upper end of the outer tube section 75. By grasping the grip, indicated 122, of the handle 120 and then rotating the handle 120 relative to the outer tube section 75 about a substantially horizontally-disposed axis of rotation, the screw 114 is forced to rotate about its substantially vertically-disposed longitudinal axis.

With reference again to FIGS. 1, 2, 6 and 7, the carriage assemblies 100, 102 are supported upon the jack-extendible telescoping post assemblies 64 and 66 for movement of the carriage assemblies 100 and 102 upwardly or downwardly relative to the frame 40 as the outer tube section 75 is moved upwardly or downwardly relative to the first inner tube section 76. To this end and as best shown by the carriage assembly 100 of the FIG. 8, each carriage assembly 100 or 102 includes a pair of identically-shaped plates 130, 132 which arranged in substantially a parallel relationship with one another. Each plate 130, 132 is elongated in shape and has two opposite ends 126, 128 and is shaped so as to provide a cutout 153 along one (the upper) edge thereof and two boss portions 156, 158 which protrude from one end 126 thereof. In addition, the plates 130, 132 are joined together with strut members 134 and 136 which extend between the plates 130, 132.

Figure 8:
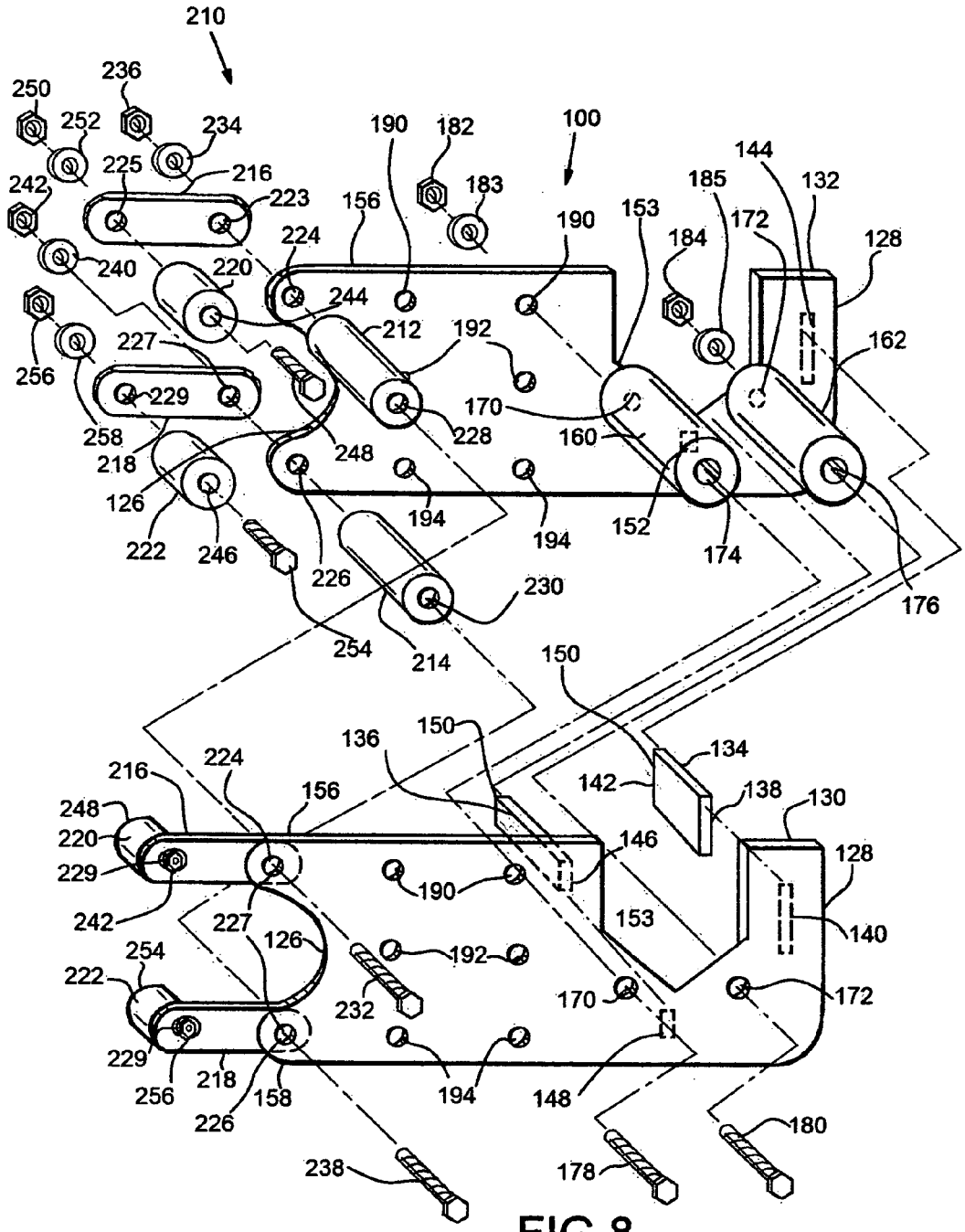
FIG. 8 is a perspective view of one of the carriage assemblies of the FIG. 1 embodiment, shown exploded.

More specifically and as best shown in FIG. 8, one strut member 134 is elongated (and substantially rectangular) in shape and has one linear edge 138 which is attached (e.g. as with welds) to the inner surface of the plate 130 at a location 140 (depicted in phantom) therealong and has an opposite linear edge 142 which is attached (as with welds) to the inner surface of the plate 132 at a location 144 (depicted in phantom) therealong. Similarly, the other strut member 136 is elongated (and substantially rectangular) in shape and has one linear edge 146 which is attached (as with welds) to the inner surface of the plate 130 at a location 148 (depicted in phantom) therealong and has an opposite linear edge 150 which is attached (as with welds) to the inner surface of the plate 132 at a location 152 (depicted in phantom) therealong. Together, the strut members 134, 136 hold the plates 130 and 132 in a fixed and stationary relationship with respect to one another, and as will be apparent herein, the cutouts 153 of the plates 130, 132 collectively provide a notch 154 for carriage assembly 100 or 102 which opens generally upwardly with respect to the frame 40, as best shown in FIG. 1.

Each carriage assembly 100, 102 also includes a pair of cylindrical rollers 160, 162 (FIGS. 8-10) which are supported between the plates 130, 132 and adjacent the cutout 153 thereof for rotation about substantially parallel axes. In this connection, there is provided within each plate 130 or 132 a pair of through-openings 170, 172 which are aligned with the through-openings 170, 172 of the other plate 132 or 130. Each roller 160 or 162 includes internal bearings through which is provided a central opening 174 or 176, and the rollers 160 and 162 are positioned between the plates 130, 132 so that the central openings 174, 176 thereof are aligned with the aligned through-openings 170, 172. Bolts 178, 180 are directed shank end-first through the aligned openings 170, 174 and 172, 176 and secured therethrough with nuts 182, 184 (and washers 183, 185).

As best shown in FIG. 10, the rollers 160, 162 are large enough in diameter so that the outer cylindrical surfaces thereof extend above the bottom edges of the cutouts 153, so that when the end portions 17, 18 of tube 16 (FIG. 3) are fully accepted by the notches 154 of the carriage assemblies 100, 102 for spool-lifting purposes, the tube end portions 17, 18 rest upon the cylindrical surfaces of the rollers 160, 162 of the carriage assemblies 100, 102 and are free to rotate about the longitudinal axis of the tube 16 atop the rollers 160, 162 without interference from the plates 130, 132. It will also be understood that the rollers 160, 162 are adapted to rotate about rotational axes which are oriented substantially horizontally and which traverse the frame 40.

For securement of the plates 130, 132 about the outer tube section 75 (and thus secure each carriage assembly 100 or 102 to a corresponding post assembly 64 or 66, respectively), each plate 130 or 132 includes two vertically-aligned rows of openings 190, 192, 194 which are aligned with the rows of openings 190, 192, 194 provided in the other plate 132 or 130, and the outer tube section 75 is positioned between the plates 130, 132 thereof so as to be disposed between the two rows of openings 190, 192, 194. Bolts 196, 198, 200 (FIGS. 9 and 10) are directed through the aligned openings 190, 192, 194 and nuts 204 (with washers 202) are tightly threaded upon the externally-threaded ends of the bolts 196, 198, 200 opposite the heads thereof so that the outer tube section 75 is tightly sandwiched between the heads of the bolts 196, 198, 200 and the nuts 204 threaded thereon.

In practice, the spaced distance between the plates 130, 132 is slightly larger than the width of the outer tube section 75 so that when the plates 130, 132 are positioned about the outer tube section 75, the plates 130, 132 need only be tightened, or squeezed, together (by way of the bolts 196, 198, 200 and nuts 204) by a relatively small amount in order for the inner surfaces of the plates 130, 132 to frictionally grip the outer surfaces of the outer tube section 75 and thereby be prevented from shifting (upwardly or downwardly) along the length of the outer tube section 75. However and to further reduce any likelihood that the carriage assemblies 100, 102 could slip (i.e. downwardly) along the length of the outer tube section 75 during the use of the apparatus 20, stop members 206 (FIG. 11) have been attached (e.g. welded) along the length of the outer tube section 75 and immediately below the shanks of bolts 196, 198 used to secure the plates 130, 132 about the outer tube section 75. Therefore and in the event that the carriage assembly 100 or 102 were to slip downwardly along the surfaces of the outer tube section 75, the shanks of the bolts 196, 198 will come to rest upon the stop members 206 to prevent additional downward movement of the carriage assembly 100 or 102 along the outer tube section 75.

Figure 11:
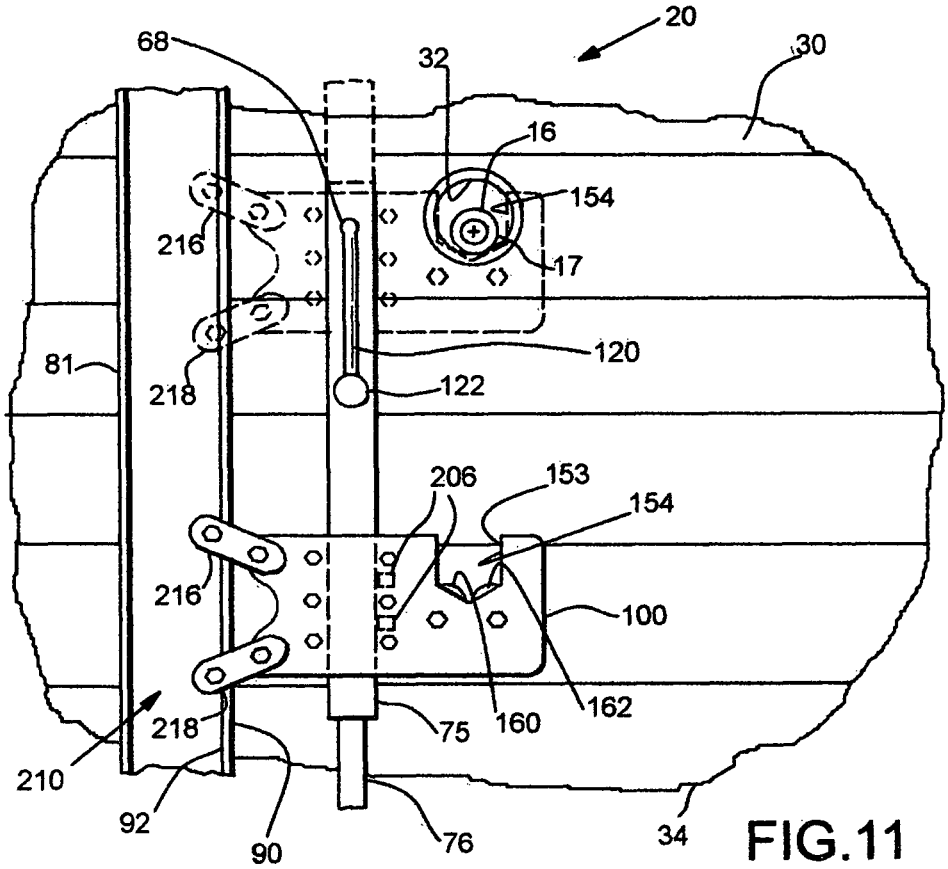
FIG. 11 is a side elevation view of a fragment of the FIG. 1 apparatus and a fragment of a spool intended to be lifted by the apparatus.

It follows from the foregoing that as the lower and upper ends 72, 74 of the post assemblies 64, 66 are moved toward or away from one another by way of the jack assemblies 68, 70 or through a re-adjustment of the (lengthwise) positional relationship between the first and second inner tube sections 76, 77 or between the second and third inner tube sections 77, 78, the carriage assemblies 100, 102 are moved upwardly or downwardly relative to the frame 40 by a corresponding amount. As will be apparent herein and as best shown in FIG. 11, this capacity of the carriage assembly 100 or 102 to be moved upwardly or downwardly in conjunction with the movement of the lower and upper ends 72, 74 toward and away from one another enables the carriage assembly 100 or 102 to be raised or lowered with respect to the tube 16 positioned through the barrel 32 of the spool 30 between, for example, a lowered position, as illustrated in solid lines in FIG. 11, at which the upwardly-opening notch 154 is disposed at a location spaced beneath the tube end portion 17 or 18 and an elevated position, as illustrated in phantom in FIG. 11, at which the upwardly-opening notch 154 accepts the tube end portion 17 or 18 in a nested relationship at which the tube end portion 17 or 18 rests atop the rollers 160, 162 of the carriage assembly 100 or 102.

It is another feature of the apparatus 20 that each carriage assembly 100 or 102 includes an arrangement, generally indicated 210 in FIGS. 9 and 10, of cylindrical rollers which cooperate with the corresponding guide post 81 or 83 in a manner which permits the carriage assemblies 100, 102 to be rollably guided upwardly or downwardly along the length of the guide posts 81, 83 as the carriage assemblies 100, 102 are raised or lowered relative to the frame 40 by way of the telescoping post assemblies 64 and 66. To this end, the roller arrangement 210 includes a first pair of rollers 212, 214 which are positioned between the plates 120, 132 or, more specifically, the boss portions 156, 158 provided adjacent the plate ends 126, and are positioned therebetween so that the rollers 212, 214 are arranged so that the rotational axes thereof are substantially parallel to one another. Meanwhile, the boss portions 156, 158 are provided with horizontally-disposed through-openings 224, 226 which are aligned with the through-openings 224, 226 provided within the boss portions 156, 158 of the other plate 132 or 130 for securement of the rollers 212, 214 therebetween in a manner apparent herein.

In addition, there are provided two sets of plate-like linkage members 216, 218 which are joined to the boss portions 156, 158 and which support a second pair of rollers 220, 222 for rollably engaging the surfaces 92 of the channel portion 86 as the carriage assembly 100 or 102 is guided therealong. As best shown in FIG. 8, each linkage member 216 or 218 includes a pair of through-openings 223, 225 or 227, 229 and one set of linkage members 216 are disposed outboard of the boss portions 156 of the plates 130, 132 (and on opposite sides thereof) so that the through-opening 223 of each linkage member 216 is aligned with the through-opening 224 of the boss portions 156 and the central opening, indicated 228 in FIG. 6, of the roller 220 while the other set of linkage members 218 are disposed outboard of the boss portions 158 of the plates 130, 132 (and on opposite sides thereof) so that the through-openings 227 of each linkage member 218 is aligned with the through-opening 226 of the boss portions 158 and the central opening, indicated 230 in FIG. 8, of the roller 220.

A bolt 232 is directed shank end-first through the aligned through-openings 223, 224 and central opening 228, and a nut 236 is threaded upon the shank end of the bolt 232 so that the linkage members 216, boss portions 156 and roller 220 are secured between the head of the bolt 232 and the nut 236. If desired, a washer 234 can be positioned upon the shank of the bolt 232 between the nut 236 and the linkage members 216 through which the bolt 232 extends. Similarly, a bolt 238 is directed shank end-first through the aligned through-openings 227, 226 and central opening 230, and a nut 242 is threaded upon the shank end of the bolt 238 so that the linkage members 218, boss portions 158 and roller 222 are secured between the head of the bolt 238 and the nut 242. If desired, a washer 240 can be positioned upon the shank of the bolt 238 between the nut 242 and the linkage member 218 through the bolt 238 extends.

With reference still to FIG. 8, each of the rollers 220 is disposed adjacent the inboard side surface of the linkage member 216 and arranged in such a relation thereto so that the central opening, indicated 244, of the roller 220 is aligned with the through-opening 225 of the linkage member 216; and each of the rollers 222 is disposed adjacent the inboard side surface of the linkage member 218 and arranged in such a relation thereto so that the central opening, indicated 246, of the roller 222 is aligned with the through-opening 229 of the linkage member 218.

A bolt 248 is directed shank end-first through the aligned through-opening 225 and central opening 244, and a nut 250 (with washer 252) is threaded upon the bolt 248 so that each linkage member 216 and corresponding roller 220 is maintained between the head of the bolt 248 and the nut 250. Similarly, a bolt 254 is directed shank end-first through the aligned through-opening 229 and central opening 246, and a nut 256 (with washer 258) is threaded upon the bolt 254 so that each linkage member 218 and corresponding roller 222 is maintained between the head of the bolt 254 and the nut 256. It will be understood that the central through-opening of each roller 212, 214, 220 or 222 is provided by an internal bearing which permits the roller to rotate about its longitudinal axis, even though the internal bearing is tightly held between the head of the bolt which extends through the roller through-opening and the nut which is threaded upon the bolt.

As best shown in FIGS. 9 and 10, each carriage assembly 100 or 102 is arranged about its corresponding guide post 81 or 83 so that the cylindrical surfaces of the rollers 212 and 214 engage the planar surface 90 defined along one side of the channel portions 86, 88 of the guide post 81 or 83 and so that the cylindrical surfaces of the rollers 220, 222 engage the planar surface 92 defined along the channel portions 86, 88 opposite the surface 90. With the rollers 212, 214, 220 and 222 positioned in engagement with the channel portions 86, 88 in this manner, each guide post 81 or 83 is captured within the arrangement 210 of rollers so that movement of the carriage assemblies 100, 102 relative to the guide posts 81, 83 is limited to movement upwardly or downwardly along the length of the guide posts 81, 83 as the rollers 212, 214, 220 and 222 rollably engage the corresponding ones of the surfaces 90, 92 of the channel portions 86, 88. It follows that as the carriage assemblies 100, 102 are moved upwardly or downwardly with respect to the frame 40 by way of the jack-extendible post assemblies 64 and 66, each guide post 81 or 83 and corresponding carriage assembly 100 or 102 act as guide track and guide track follower, respectively, as the arrangement 210 of rollers of the carriage assemblies 100, 102 roll upwardly or downwardly along the surfaces 90, 92 of the guide posts 81, 83.

To utilize the apparatus 20 for lifting the spool 30 which rests upon a floor 26 and whose barrel has a tube 16 positioned therein, as depicted in phantom FIG. 3, so that the end portions 17, 18 of the tube 16 extend outboard of the spool flanges 34, the apparatus 20 is wheeled, or otherwise manipulated, about the spool 30 so that the elongated sections 42, 44 are disposed on opposite sides of the spool 30 (and outboard of the flanges 34, 36 thereof) so that the upwardly-opening notch 154 provided in each carriage assembly 100 or 102 is disposed beneath and in substantially vertical registry with a corresponding end portion 17 or 18 of the tube 16, as depicted in solid lines in FIG. 11. If the notches 154 of the carriage assemblies 100, 102 are disposed below the tube end portions 17, 18 by an appreciable distance, as may be the case if the spool 30 is quite large in diameter, the carriage assemblies 100, 102 can be raised to a position much closer to the tube end portions 17, 18 (i.e. within a few inches) by manually extending the telescoping post assemblies 64, 66 by way of the telescoping inner tube sections 76, 77 and 78, rather than by way of the jack assemblies 68, 70.

In other words, by removing one or both of the pins 97, 108 from the aligned through-openings provided in the first and second inner tube sections 76, 77 and/or from the aligned through-openings provided in the second and third inner tube sections 77, 78, and then manually lifting the carriage assemblies 100 and 102 away from the frame base 41 to lengthen the post assemblies 64, 66 and thereby adjust the positional relationship between the first and second inner tube sections 76, 77 and/or thereby adjust the positional relationship between the second and third inner tube sections 77, 78, the carriage assemblies 100, 102 can be raised to a position much closer to the tube end portions 17, 18 relatively quickly. To re-secure the first and second inner tube sections 76, 77 or the second and third inner tube sections 77, 78 in a fixed stationary position with respect to one another, the pins 97 and/or 108 are re-inserted into an alternative pair of aligned through-openings in the first and second inner tube sections 76, 77 and/or in the second and third inner tube sections 77, 78.

Once the bottom of the notches 154 of the carriage assemblies 100, 102 have been raised to within a few inches of the tube end portions 17, 18 by altering, if necessary, the positional relationship between the first and second inner tube sections 76, 77 and/or the positional relationship between the second and third inner tube sections 77, 78 as aforedescribed, the handle 120 of the jack assemblies 68 and 70 can be rotated in the appropriate rotational direction about its horizontally-disposed rotational axis to raise the rollers 160, 162 of the carriage assemblies 100, 102 into engagement with the tube end portions 17, 18 and for ultimately lifting the spool 30 so that the rims 35 of its flanges 34 are in an elevated position above the floor 26. Supported above the floor 26 in such a manner, the spool 30 is free to be rotated about the longitudinal axis of its barrel 32 as the tube end portions 17, 18 are free to rotate atop the rollers 160, 162. Furthermore and as best shown in FIG. 12, a forklift 21 can be used to lift and move the apparatus 20 and any spool 30 supported thereby by directing the forks 25 of the forklift 21 tip end-first into the open ends of the elongated sections 42, 44 disposed at the rear of the frame 40 (as shown in FIG. 12) or, in the alternative, into (and through both sets of) the forklift brackets 63, 65 attached to the base 41 on the underside of the elongated sections 42, 44 from either side of the frame 40 and then lifting the frame 41 from the floor 26 with the forks 25.

An advantage provided by the telescoping post assemblies 64, 66 relates to the fact that the spaced distance between the lower and upper ends 72, 74 thereof can be altered by either of two methods. One such method involves the use of the jack assemblies 68, 70 for telescopically moving the outer tube section 75 and the first inner tube section 76 relative to one another, and the other method involves the adjustment in the positional relationship between the first and second inner tube sections 76, 77 and/or between the second and third inner tube sections 77, 78 by telescopically shifting the inner tube sections 76, 77 or the inner tube sections 77, 78 relative to one another to an alternative positional relationship and then re-securing (with the pins 97, 108) the inner tube sections 76, 77 or the inner tube sections 77, 78 in the alternative positional relationship.

In practice and due, at least in part, to the fact that large scale adjustments to the spaced distance between the lower and upper ends 72, 74 of the telescoping post assemblies 64, 66 are normally made more quickly by adjusting the positional relationship between the first and second inner tube sections 76, 77 and between the second and third inner tube sections 77, 78 than can be made with by way of the jack assemblies 68, 70, it is preferable that any initial (e.g. large scale) adjustments be made to the height of the post assemblies 44, 46 by first altering the positional relationship between the first and second inner tube sections 76, 77 and/or between the second and third inner tube sections 77, 78 before the jack assemblies 68, 70 are used to move the lower and upper ends 72, 74 of the post assemblies 64 and 68 apart.

Another advantage provided by the telescoping outer and inner tube sections 75, 76, 77, 78 relates to the fact that the telescoping capacity of these multiple sections enables the post assemblies 64, 66 to be adjusted in height between a relatively short condition at which the tube sections are collapsed, as best shown in FIG. 1, and a relatively high condition at which the tube sections are fully extended, as best shown in FIG. 7. This telescoping capacity enables the apparatus 20 to be used to lift spools from the floor whose diameter falls within a relatively large range of diameters (e.g. between about sixteen inches and twelve feet).

Still another advantage provided by the apparatus 20 relates to the capacity of the guide posts 81, 83 to strengthen, and thus rigidify, the telescoping post assemblies 64, 66 while a spool 30 is supported above the floor 26 by the apparatus 20. In this regard, much of this strengthening capacity of the guide posts 81, 83 is due, at least in part, to the captured relationship of the channel portions 84, 86 by the arrangement 210 of rollers of the carriage assemblies 100, 102 so that in the event that the apparatus 20 is somehow leaned or tipped in such a manner that its telescoping post assemblies 64, 66 are no longer vertical, the guide posts 81, 83 provide a base to which the arrangement 210 of rollers remains solidly attached. This strengthening capacity of the guide posts 81, 83 can be readily appreciated in view of the fact that during a process to lift the apparatus 20, and any spool 30 supported thereby, with a forklift 21 or an overhead crane for movement of the apparatus 20 and spool 30 to an alternative site, the apparatus 20 could be leaned or tipped in a manner which moves the post assemblies 64, 66 out of a true vertical orientation.

Exemplary dimensions of the apparatus 20 are provided here as follows: The length of each elongated section 42 or 44 is about fifty inches; each elongated section 42 or 44 is about five inches in width (as measured laterally across its top surface); the height of each telescoping post assembly 64 or 66 when in its collapsed condition (i.e. shortest condition), is about twenty-five inches; the vertical height of each guide post 81 or 83 is about forty-eight inches; the cross section of the channel of each guide post 81 or 83 can measure about six inches along (the length of) its primary portion 85 and about four inches in width, as measured laterally across the channel surface 90 thereof; the plates 130, 132 of each carriage assembly 100 or 102 of each carriage assembly 100 or 102 are about 0.5 inches thick and are spaced about three inches apart; and the upwardly-opening notch 154 of each carriage assembly 130 or 132 measures about 4.5 inches in width (to accept tubes having a diameter of less than about 4.5 inches). The width of the frame 40 can be adjusted by way of the intermediate assembly 43 from between about thirty-four inches and about seventy-two inches; and each wheel 54 of a wheel assembly 55 is about six inches in diameter. An apparatus having the aforedescribed dimensions can be used to lift and support a spool 30 having a diameter within a range of between about 16.0 inches and twelve feet.

Figure 13:
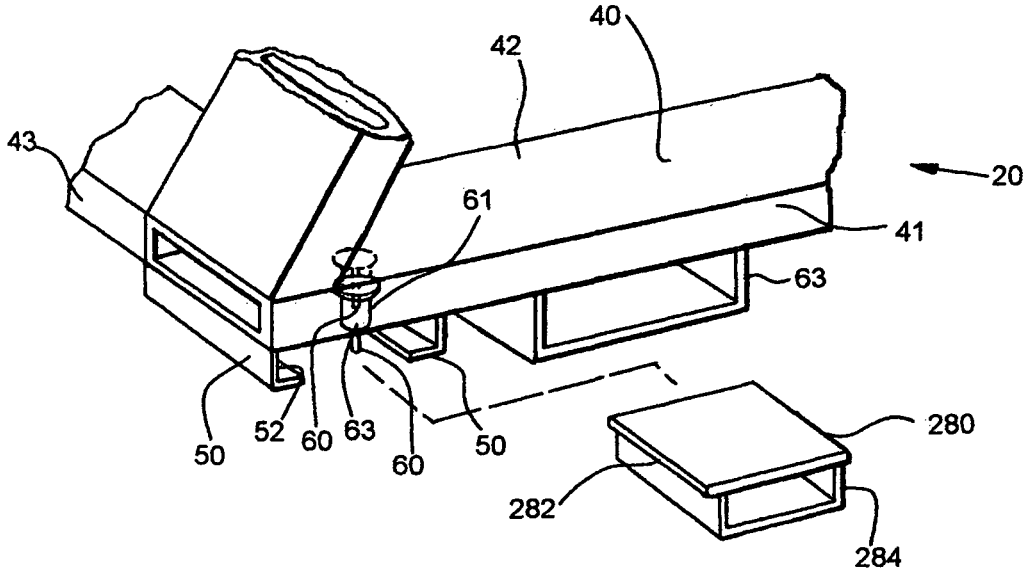
FIG. 13 is a perspective view similar to that of FIG. 5 of a fragment of the frame of the FIG. 1 apparatus and a forklift bracket capable of being attached to the frame fragment of this view.

It will be understood that numerous modifications and substitutions can be had to the aforedescribed embodiment 20 without departing from the spirit of the invention. For example, although the aforedescribed embodiment 20 has been shown and described as being usable with or without the wheel assemblies 55 (best shown in FIG. 5), alternative componentry can be connected to the frame 40 by way of the L-shaped brackets 50 and the guide tracks 52 defined therebetween. For example and with reference to FIG. 13, instead of accepting a wheel assembly 55 within its guide track 52, each guide track 52 can accept a bracket assembly 280 for accepting a fork 25 of a forklift 21 directed therethrough into one side of the frame 40. The depicted FIG. 13 bracket assembly 280 includes a steel plate 282 to which is secured (e.g. welded) a U-shaped bracket 284 on the underside thereof. As is the case with the wheel assembly 55 depicted in FIG. 5, the FIG. 13 bracket assembly 280 can be positioned within the guide track 52 by raising the spring-biased pin 60 to its retracted (FIG. 13 phantom-line) position and then directing the steel plate 282 of the bracket assembly 280 edge-first into the (open) mouth of the guide track 52 so that the side edges of the steel plate 282 are slidably guided along the L-shaped brackets 50 of the guide track 52. Upon movement of the plate 282 into abutting relationship with the stop members 56 (FIG. 5) disposed adjacent the rear of the guide track 52, the pin 60 is released from its retracted position and permitted to return to its extended (FIG. 13 solid-line) position and thereby close the mouth of the guide track 52 so that the bracket assembly 280 is captured between the stop members 56 and the pin 60. The bracket assemblies 280 can supplement or obviate the aforedescribed forklift brackets 63, 65 mounted between the base 41 of the frame 40.

Figure 14:
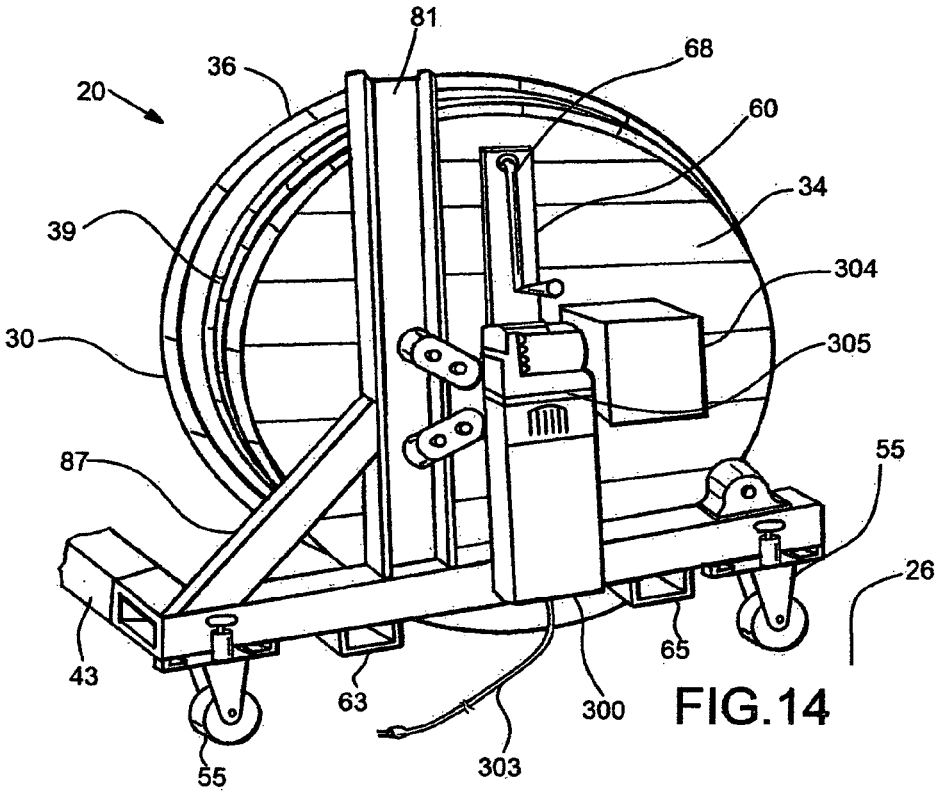
FIG. 14 is perspective view of a fragment of the FIG. 1 apparatus and a motor assembly which can be attached to the FIG. 1 apparatus for drivingly rotating the spool, when lifted to an elevated condition above the floor, about a rotational axis.
Figure 15:
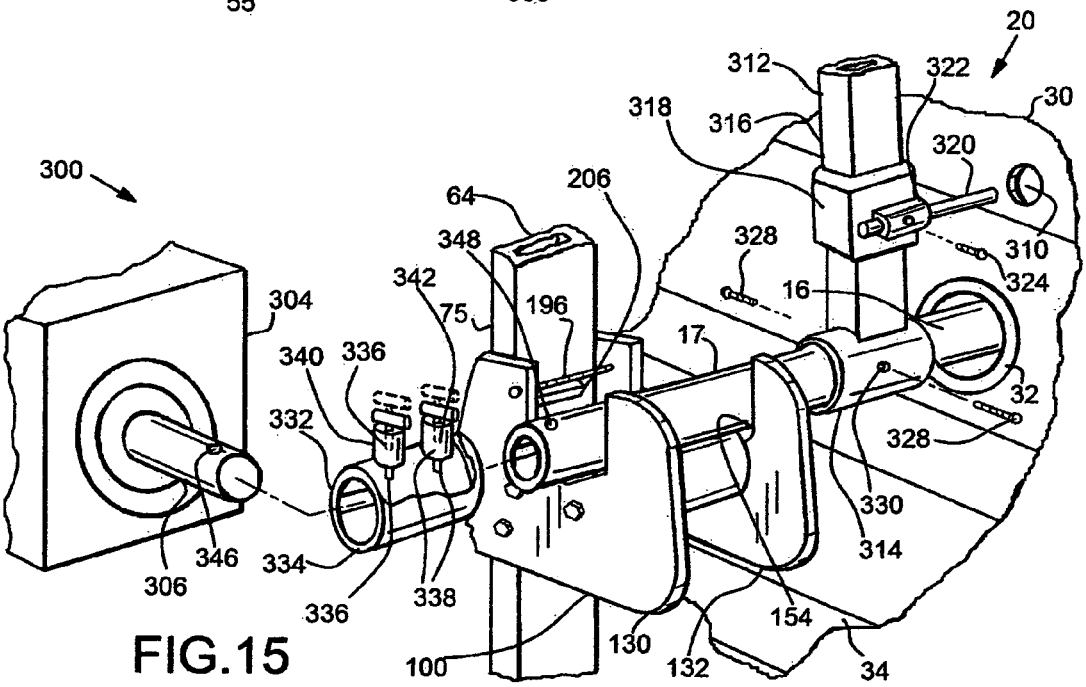
FIG. 15 is a perspective view of the motor assembly and related components of FIG. 14, shown exploded.

Further still and with reference to FIGS. 14 and 15, the aforedescribed apparatus 20 can be equipped with a motor assembly 300 for drivingly rotating the spool 30 about the longitudinal axis of its barrel 32 when the spool 30 is lifted from the floor 26 by way of the apparatus 20 and the tube 16. In this connection, the assembly 300 includes an electric motor 302 which is adapted to receive electrical power through a cord 303 and which is mounted upon the carriage assembly 100 by way of a suitable bracket 305. The assembly 300 also includes a gear box 304 disposed adjacent one end of the motor 302 and having an output drive shaft 306. The drive shaft of the motor 302 is appropriately connected to the gear box 304 so that operation of the motor 302 effects the rotation of the output drive shaft 306. If desired, the motor 302 can be a reversible motor which provides a user with the option of rotating the drive shaft 306 in one or the other rotational direction about its longitudinal axis for rotating the spool 30 in one or the other rotational direction about the longitudinal axis of the barrel 32.

For purposes of transferring the rotational forces of the output drive shaft 306 to the spool 30, there is provided within a flange 34 of the spool 30 an preformed opening 310 (best shown in FIG. 15) disposed to one side of the barrel 32 of the spool 30, and a bracket assembly 312 is mounted upon the tube 16 for cooperating between the tube 16 and the spool 30 so that rotation of the tube 16 effects the forced rotation of the spool 30 about the longitudinal axis of its barrel 32. More specifically, the bracket assembly 312 includes a tubular section 314 which is positioned about the tube end portion 17 adjacent the spool flange 34, and a linear member 316 (formed, for example, of steel channel having a substantially square cross section) is attached (e.g. welded) to the tubular section 314 so as to extend radially outwardly from one side thereof. A steel sleeve member 318 is slidably mounted upon the linear member 316, and a pin 320 is connected to the sleeve member 318 by way of an apertured boss portion 322 secured to one side thereof for acceptance by the opening 310 provided in the flange 34, and a set screw 324 is directed through one side of the boss portion 322 and against the side of the pin 302. As the tube 16 is rotated about its longitudinal axis, the spool 30 is forced to rotate by way of the pin 320 (having an end which is accepted by the flange opening 310) as the sleeve member 318 is permitted to shift along the length of the linear member 316 during a revolution of the spool 30 about its rotational axis to compensate for the variation in spacing between the preformed opening 310 and the tube 16 through a signal revolution of the spool 30.

To connect the bracket assembly 312 between the tube 16 and the spool flange 34, the tubular section 314 is slid over the tube end portion 17 toward the flange 34, and the pin 320

(which is fixed in position along the aperture of the boss portion 322 by way of the set screw 324) is directed into the preformed opening 310 of the spool flange 34. At that point, the tubular section 314 can be fixedly secured to the tube end portion 17 with a pair of set screws 328 which are directed through openings 330 (only one shown in FIG. 15) provided in the opposite sides of the tubular section 314 and tightened against the side surfaces thereof.

For transferring rotational forces of the drive shaft 306 to the tube 16, the motor assembly 300 also includes an adaptor 332 including a tubular section 334 and a pair of spring-biased pins 336, 338 which are slidably positioned within a pair of housings 340, 342 mounted along the side of the tubular section 334 for movement between an extended position (as depicted in solid lines in FIG. 15) at which the pins 336, 338 are disposed radially inwardly of the inner surface of the tubular section 334 and a retracted position (as depicted in phantom in FIG. 15) at which the pins 336, 338 are disposed entirely radially outwardly of the inner surface of the tubular section 334. If desired, the housings 340, 342 and pins 336, 338 can be made to cooperate with one another so that rotation of the pins 336, 338 through about ninety degrees of movement about its longitudinal axis relative to the housings 340, 342 releasably locks the pins 336, 338 in the retracted positions.

In order that the adaptor 332 cooperate with both the output drive shaft 306 of the gear box 304 and the tube 16 in its intended manner, the drive shaft 306 includes a preformed opening 346 adjacent the end thereof which opens radially outwardly of the drive shaft 300, and the tube end portion 17 is provided with a pre-formed opening 348 which opens radially outwardly of the tube end portion 17. When assembled, the tube end portion 17 is accepted by one end of the tubular section 334 of the adaptor 332, the drive shaft 306 is accepted by the other end of the tubular section 334, and each pin 336 or 338 is aligned (in registry) with and accepted by a corresponding preformed opening 348 or 346 provided in the drive shaft 306 and tube end portion 17. With each pin 336 or 338 disposed in its extended position and received by the corresponding preformed opening 348 or 346, the tube 16 is secured to the drive shaft 306 so that rotation of the drive shaft 306 in either rotational direction about its longitudinal axis effects the rotation of the spool 30 about the longitudinal axis of its barrel 32 in the corresponding (i.e. the same) rotational direction.

To disengage the tube 16 from the drive shaft 306 to, for example, permit the spool 30 to rotate freely about the rollers 212, 214 of the carriage assemblies 100, 102, the pins 336, 338 can be manually withdrawn to the retracted (FIG. 15 phantom-line) positions to withdraw the pins 336, 338 from the openings 348 and 346, and the tubular section 334 of the adaptor 332 is then shifted axially of the drive shaft 306 and tube 16 so that upon release of the pins 336, 338, the pins 336, 338 are no longer in registry with for acceptance by the openings 348 and 346 of the drive shaft 306 and tube end portion 17. With the pins 336, 338 disposed out of registry with the openings 348, 346, the spool 30 can be freely rotated about the rollers 160, 162. It follows that the aforedescribed motor assembly 300, along with the bracket assembly 312 and adaptor 332, provides a means by which the spool 30 can be drivingly rotated about the longitudinal axis of its barrel 32 for either winding a material 39 about the spool 30 or unwinding a material 39 from the spool 30 or, if desired, permitting the spool 30 to freely rotate about the rollers 212, 214 by disengaging the tube section 17 from the drive shaft 306.

Yet further still and although the jack assemblies 68, 70 of the apparatus 20 have been shown and described as being screw jacks, the jack assemblies used for altering the positional relationship between the outer tube section 75 and first inner tube section 76 of the telescoping post assemblies 64, 66 can be an alternative type of jack assembly, such as a hydraulic jack assembly.

Accordingly, the aforedescribed embodiment 20 is intended for the purpose of illustration and not as limitation.

The invention claimed is:

1. Apparatus for lifting and supporting an item in an elevated condition above an underlying floor wherein the item includes a centrally-disposed barrel having two opposite ends and about which a windable material can be either wound or unwound and two flanges wherein each flange is disposed at an end of the barrel and the item is arranged so that both flanges engage the underlying floor and the barrel of the item is oriented substantially parallel to the floor, said apparatus comprising:

a frame including a pair of sections which are joined in a stationary relationship with respect to one another and are positionable on opposite sides of the item to be lifted so that one section of the frame is disposed adjacent one flange of the item and the other section of the frame is disposed adjacent the other flange of the item, and the frame further including a pair of guide posts having two opposite ends wherein one guide post is mounted upon one of the sections of the frame so as to extend substantially upwardly therefrom and the other guide post is mounted upon the other of the sections of the frame so as to extend substantially upwardly therefrom;

a pair of elongated post assemblies having upper and lower ends wherein one of the post assemblies is mounted upon one section of the frame adjacent the guide post mounted thereon so that the upper end thereof extends substantially upwardly from said one section and the other of the post assemblies is mounted upon the other section of the frame and adjacent the guide post mounted thereon so that the upper end thereof extends substantially upwardly from said other section, and wherein the upper and lower ends of each post assembly are movable with respect to one another to alter the distance therebetween; and a pair of jacks wherein one of the two jacks is associated with one post assembly for moving the upper and lower ends of the one post assembly relative to one another to alter the distance therebetween and the other of the two jacks is associated with the other post assembly for moving the upper and lower ends of the other post assembly relative to one another to alter the distance therebetween;

a pair of carriage assemblies wherein one carriage assembly is mounted upon one post assembly and the other carriage assembly is mounted upon the other post assembly so that movement of the upper and lower ends of the post assemblies relative to one another moves the upper and lower ends of the post assemblies away from or toward one another to thereby effect the movement of the carriage assemblies upwardly or downwardly relative to the apparatus frame, and wherein each carriage assembly is cooperable with an end of the barrel of the item and with the guide post disposed adjacent the post assembly upon which the carriage assembly is mounted so that by positioning each carriage assembly in cooperating relationship with an end of the barrel of the item for purposes of lifting the end of the barrel with the carriage assembly and then moving the upper and lower ends of the post assemblies away from one another, the flange of the item which is disposed at the end of the barrel is lifted from the floor by a corresponding amount and the carriage assembly is guided along the guide post, wherein each guide post defines a substantially linear guide track which extends between the two opposite ends of the guide post, and the carriage assembly which is cooperable with the guide post includes an arrangement of rollers which rollably engage the guide track of the guide post and maintain the carriage assembly in a captured relationship with the guide post as the carriage assembly is guided along the guide post.

2. The apparatus as defined in claim 1 wherein each guide post and carriage assembly associated with a section of the frame cooperate as guide track and guide track follower so that as the upper and lower ends of the post assembly are moved relative to one another to alter the distance therebetween, the movement of the carriage assembly relative to the apparatus frame is guided along the guide post.

3. The apparatus as defined in claim 1 wherein each guide post and post assembly includes a longitudinal axis, and each guide post and post assembly is mounted upon a section of the frame so that the longitudinal axes thereof are substantially parallel.

4. The apparatus as defined in claim 1 wherein the guide track of each guide post is provided by a two-sided portion which defines a planar surface along each side of the two-sided portion, and the arrangement of rollers of each carriage assembly includes rollers which rollably engage the planar surface defined along each of the two sides of the two-sided portion so that the two-sided portion is captured between the arrangement of rollers.

5. The apparatus as defined in claim 4 wherein the rollers which rollably engage the planar surface defined along one of the two sides of the two-sided portion includes a first pair of rollers arranged in superposed relationship so that one roller of the first pair follows the other roller of the first pair along one of the two sides of the two-sided portion as the carriage assembly is guided along the length of the guide post and includes a second pair of rollers arranged in superposed relationship so that one roller of the second pair follows the other roller of the second pair along the other of the two sides of the two-sided portion as the carriage assembly is guided along the guide post.

6. The apparatus as defined in claim 1 wherein each post assembly includes telescoping inner and outer tube sections which are adapted to slidably move relative to one another to alter the spaced distance between the upper and lower ends of the post assembly, and the jack which is associated with each post assembly is adapted to act between the telescoping inner and outer tube sections for moving the upper and lower ends of the post assembly relative to one another to alter the distance therebetween.

7. The apparatus as defined in claim 6 wherein each post assembly includes additional tube sections which are interposed between the upper and lower ends of the post assembly and which are slidably movable relative to one another in a telescoping fashion and the additional tube sections are adapted to be releasably secured in alternative positional relationships with respect to one another for altering the distance between the upper and lower ends of the post assemblies so that the distance between the upper and lower ends of the post assemblies can be altered by slidably moving the additional tube sections relative to one another and into an alternative positional relationship.

8. The apparatus as defined in claim 7 wherein one of the additional tube sections has a plurality of through-openings which are defined along the length thereof, and another of the additional tube sections has a first through-opening which is defined along the length thereof, and the one and another tube sections can be slidably moved along the length of one another into an alternative positional relationship and to align said first through-opening which any of the plurality of through-openings, and the apparatus further includes a pin which is positionable through the aligned through-openings for releasably securing the additional tube sections in an alternative positional relationship with respect to one another.

9. The apparatus as defined in claim 1 further including an elongated tube having opposite end portions and which is positionable through the barrel of the item so that the opposite end portions of the tube extends outboard of the flanges of the item, and each carriage assembly defines an upwardly-extending notch for accepting an end portion of the tube when the carriage assembly is positioned in cooperating relationship with an end of the barrel so that as the carriage assembly is moved upwardly or downwardly relative to the apparatus frame, the flange of the item which is disposed at the end of the barrel is moved upwardly or downwardly as the end portion of the tube rests within the upwardly-opening notch.

10. The apparatus as defined in claim 9 wherein each carriage assembly includes a pair of plates which are secured in a stationary and substantially parallel relationship with one another and so that the plates are arranged in substantially vertical planes, and each plate of the pair of plates defines a cutout therein which provides, with the cutout of the other plate of the pair of plates, the upwardly-opening notch in the carriage assembly, and each carriage assembly includes a pair of rollers which are each mounted between the plates of the pair of plates for rotation about an axis of rotation which is substantially parallel to the longitudinal axis of the elongated tube and wherein the rollers have peripheral surfaces which are disposed within the upwardly-opening notch of the carriage assembly so that when an end portion of the tube is accepted by an upwardly-opening notch of the carriage assembly for upward or downward movement therewith, the end portion of the tube rests between the rollers and is free to rotate about its longitudinal axis to accommodate the winding of a windable material about the barrel of the item or the unwinding of the windable material from the barrel of the item.

11. The apparatus as defined in claim 10 further comprising a motor-powered assembly associated with one of the carriage assemblies and including a motor which is connectable in driving relationship with the elongated tube and a bracket which is positionable about the elongated tube and cooperable with a flange of the item so that rotation of the elongated tube about its longitudinal axis by way of the motor effects the rotation of the item relative to the apparatus frame about the longitudinal axis of the barrel of the item.

12. Apparatus for lifting and supporting an item in an elevated condition above an underlying floor wherein the item includes a centrally-disposed barrel having two opposite ends and about which a windable material can be either wound or unwound and two flanges wherein each flange is disposed at each end of the barrel and has a rim along the periphery thereof and the item is arranged so that the rims of both flanges engage the underlying floor and the barrel of the item is oriented substantially parallel to the floor, said apparatus comprising:

a frame including a pair of sections which are joined in a stationary relationship with respect to one another and are positionable on opposite sides of the item to be lifted so that one section of the frame is disposed adjacent one flange of the item and the other section of the frame is disposed adjacent the other flange of the item;

a pair of elongated telescoping post assemblies wherein one of the telescoping post assemblies is mounted upon one section of the frame and the other of the telescoping post assemblies is mounted upon the other section of the frame and wherein each post assembly has opposite upper and lower ends and is mounted upon the section of the frame upon which the post assembly is mounted so that the upper end of the post assembly extends substantially upwardly from the section of the frame, and wherein the upper and lower ends of each post assembly are movable relative to one another to alter the distance between the opposite upper and lower ends of the post assembly; and a pair of carriage assemblies wherein one carriage assembly is mounted upon one of the telescoping post assemblies and the other carriage assembly is mounted upon the other of the telescoping post assemblies so that movement of the upper and lower ends of each post assembly relative to one another effects the raising or lowering of the carriage assembly mounted thereon relative to the apparatus frame;

a pair of jacks wherein one of the two jacks is associated with one of the telescoping post assemblies and the other of the two jacks is associated with the other of the telescoping post assemblies, and wherein each jack is adapted to move the upper and lower ends of the telescoping post assembly relative to one another to thereby raise and lower the carriage assembly mounted upon the post assembly relative to the apparatus frame;

wherein each carriage assembly is cooperable with an end of the barrel of the item so that by positioning each carriage assembly in cooperating relationship with an end of the barrel of the item and then moving the upper and lower ends of the post assemblies relative to one another to increase the distance therebetween, the flange of the item which is disposed at the end of the barrel is lifted from the floor by way of the carriage assembly; and the frame also includes a pair of guide posts having two opposite ends wherein one guide post is mounted upon one section of the frame so as to extend substantially upwardly therefrom and adjacent the telescoping post assembly mounted upon the one section and the other guide post is mounted upon the other section of the frame so as to extend substantially upwardly therefrom and adjacent the telescoping post assembly mounted upon the other section; and each carriage assembly is adapted to cooperate with the guide post adjacent the telescoping post assembly upon which the carriage assembly is mounted so that as the carriage assembly is raised or lowered relative to the apparatus frame as the distance between the upper and lower ends of the telescoping post assembly is altered, the carriage assembly is guided along the guide post, wherein each guide post defines a substantially linear guide track which extends between the two opposite ends of the guide post, and the carriage assembly which is cooperable with the guide post includes an arrangement of rollers which rollably engage the guide track of the guide post and maintain the carriage assembly in a captured relationship with the guide post as the carriage assembly is guided along the guide post.

13. The apparatus as defined in claim 12 wherein the frame includes forklift brackets for accepting the forks of a forklift with which the apparatus and any item supported thereby can be raised from the floor.

14. The apparatus as defined in claim 12 further comprising wheels which are secured to the frame so that the apparatus and an item supported thereby can be wheeled across the floor.

15. The apparatus as defined in claim 14 wherein the wheels are removably secured to the frame so that when the wheels are removed from the frame, the apparatus frame can rest directly upon the floor.

16. The apparatus as defined in claim 12 wherein each of the telescoping post sections includes an inner tube section which provides one end of the opposite upper and lower ends of the post assembly and an outer tube section which provides the other end of the opposite upper and lower ends of the post assembly and wherein one of the opposite upper and lower ends of the post assembly is mounted upon a section of the frame for supporting the post assembly in a substantially vertical orientation with respect thereto and wherein the inner and outer tube sections are movable relative to one another in a telescoping fashion to alter the spaced distance between the opposite upper and lower ends of the telescoping post assembly.

17. The apparatus as defined in claim 12 wherein each of the telescoping post assemblies includes telescoping inner and outer tube sections which are adapted to slidably move relative to one another to alter the distance between the upper and lower ends of the post assembly, and the jack which is associated with each post assembly is adapted to act between the telescoping inner and outer tube sections for moving the upper and lower ends of the post assembly relative to one another to alter the distance therebetween.

18. Apparatus for lifting and supporting an item in an elevated condition above an underlying floor wherein the item includes a centrally-disposed barrel having two opposite ends and about which a windable material can be either wound or unwound and two flanges wherein each flange is disposed at each end of the barrel and has a rim along the periphery thereof and the item is arranged so that the rims of both flanges engage the underlying floor and the barrel of the item is oriented substantially parallel to the floor, and an elongated tube having two opposite end portions is positioned within the barrel of the item so that the two opposite ends of the barrel extend outboard of the flanges of the item, said apparatus comprising:

a frame including a pair of sections which are joined in a stationary relationship with respect to one another and are positionable on opposite sides of the item to be lifted so that one section of the frame is disposed adjacent one flange of the item and the other section of the frame is disposed adjacent the other flange of the item, and the frame further including a pair of guide posts having two opposite ends wherein one guide post is mounted upon one of the sections of the frame so as to extend substantially upwardly therefrom and the other guide post is mounted upon the other of the sections of the frame so as to extend substantially upwardly therefrom;

a pair of elongated post assemblies having upper and lower ends wherein one of the post assemblies is mounted upon one section of the frame adjacent the guide post mounted thereon so that the upper end thereof extends substantially upwardly from said one section and the other of the post assemblies is mounted upon the other section of the frame and adjacent the guide post mounted thereon so that the upper end thereof extends substantially upwardly from said other section, and wherein the upper and lower ends of each post assembly are movable with respect to one another to alter the distance therebetween; and a pair of jacks wherein one of the two jacks is associated with one post assembly for moving the upper and lower ends of the one post assembly relative to one another to alter the distance therebetween and the other of the two jacks is associated with the other post assembly for moving the upper and lower ends of the other post assembly relative to one another to alter the distance therebetween;

a pair of carriage assemblies wherein one carriage assembly is mounted upon one post assembly and the other carriage assembly is mounted upon the other post assembly so that movement of the upper and lower ends of the post assemblies relative to one another moves the upper and lower ends of the post assemblies away from or toward one another to thereby effect the movement of the carriage assemblies upwardly or downwardly relative to the apparatus frame, and wherein each carriage assembly includes an upwardly-opening notch which is positionable beneath and in substantial vertical registry with an end portion of the elongated tube positioned within the barrel of the item so by positioning the upwardly-opening notch of each carriage assembly beneath and in substantial vertical registry with an end portion of the elongated tube positioned within the barrel of the item and then moving the upper and lower ends of the post assemblies away from one another, the carriage assemblies act upwardly upon the tube end portions so that the ends of the barrel are lifted from the floor by a corresponding amount and the carriage assemblies are guided along the guide posts, wherein each guide post defines a substantially linear guide track which extends between the two opposite ends of the guide post, and the carriage assembly which is cooperable with the guide post includes an arrangement of rollers which rollably engage the guide track of the guide post and maintain the carriage assembly in a captured relationship with the guide post as the carriage assembly is guided along the guide post.

19. Apparatus for lifting and supporting an item in an elevated condition above an underlying floor wherein the item includes a centrally-disposed barrel having two opposite ends and about which a windable material can be either wound or unwound and two flanges wherein each flange is disposed at each end of the barrel and has a rim along the periphery thereof and the item is arranged so that the rims of both flanges engage the underlying floor and the barrel of the item is oriented substantially parallel to the floor, said apparatus comprising:

a frame including a pair of sections which are joined in a stationary relationship with respect to one another and are positionable on opposite sides of the item to be lifted so that one section of the frame is disposed adjacent one flange of the item and the other section of the frame is disposed adjacent the other flange of the item;

a pair of elongated telescoping post assemblies wherein one of the telescoping post assemblies is mounted upon one section of the frame and the other of the telescoping post assemblies is mounted upon the other section of the frame and wherein each post assembly has opposite upper and lower ends and is mounted upon the section of the frame upon which the post assembly is mounted so that the upper end of the post assembly extends substantially upwardly from the section of the frame, and wherein the upper and lower ends of each post assembly are movable relative to one another to alter the distance between the opposite upper and lower ends of the post assembly; and a pair of carriage assemblies wherein one carriage assembly is mounted upon one of the telescoping post assemblies and the other carriage assembly is mounted upon the other of the telescoping post assemblies so that movement of the upper and lower ends of each post assembly relative to one another effects the raising or lowering of the carriage assembly mounted thereon relative to the apparatus frame;

a pair of jacks wherein one of the two jacks is associated with one of the telescoping post assemblies and the other of the two jacks is associated with the other of the telescoping post assemblies, and wherein each jack is adapted to move the upper and lower ends of the telescoping post assembly relative to one another to thereby raise and lower the carriage assembly mounted upon the post assembly relative to the apparatus frame;

wherein each carriage assembly is cooperable with an end of the barrel of the item so that by positioning each carriage assembly in cooperating relationship with an end of the barrel of the item and then moving the upper and lower ends of the post assemblies relative to one another to increase the distance therebetween, the flange of the item which is disposed at the end of the barrel is lifted from the floor by way of the carriage assembly; and the frame also includes a pair of guide posts having two opposite ends wherein one guide post is mounted upon one section of the frame so as to extend substantially upwardly therefrom and adjacent the telescoping post assembly mounted upon the one section and the other guide post is mounted upon the other section of the frame so as to extend substantially upwardly therefrom and adjacent the telescoping post assembly mounted upon the other section;

each carriage assembly is adapted to cooperate with the guide post adjacent the telescoping post assembly upon which the carriage assembly is mounted so that as the carriage assembly is raised or lowered relative to the apparatus frame as the distance between the upper and lower ends of the telescoping post assembly is altered, the carriage assembly is guided along the guide post, wherein each guide post defines a substantially linear guide track which extends between the two opposite ends of the guide post, and the carriage assembly which is cooperable with the guide post includes an arrangement of rollers which rollably engage the guide track of the guide post as the carriage assembly is guided along the guide post, and wherein each of the telescoping post assemblies includes telescoping inner and outer tube sections which are adapted to slidably move relative to one another to alter the distance between the upper and lower ends of the post assembly, and the jack which is associated with each post assembly is adapted to act between the telescoping inner and outer tube sections for moving the upper and lower ends of the post assembly relative to one another to alter the distance therebetween.

* * * * *